US009175472B1

(12) United States Patent
Calini

(10) Patent No.: US 9,175,472 B1
(45) Date of Patent: Nov. 3, 2015

(54) SELF-ADJUSTING HEEL JOINT CONNECTOR

(71) Applicant: Anthony J. Calini, Guilford, CT (US)

(72) Inventor: Anthony J. Calini, Guilford, CT (US)

( * ) Notice: Subject to any disclaimer, the term of this patent is extended or adjusted under 35 U.S.C. 154(b) by 0 days.

(21) Appl. No.: 14/603,736

(22) Filed: Jan. 23, 2015

(51) Int. Cl.

| | |
|---|---|
| ***E04B 1/38*** | (2006.01) |
| ***E04C 5/00*** | (2006.01) |
| ***E04B 7/04*** | (2006.01) |
| ***E04B 1/41*** | (2006.01) |
| ***E04C 3/12*** | (2006.01) |

(52) U.S. Cl.
CPC . *E04B 7/045* (2013.01); *E04B 1/40* (2013.01); *E04C 3/12* (2013.01); *E04B 2001/405* (2013.01); *E04B 2103/06* (2013.01)

(58) Field of Classification Search
CPC ..... E04B 7/045; E04B 1/40; E04B 2103/06; E04B 2001/405; E04C 3/12
USPC ..... 52/698
See application file for complete search history.

(56) References Cited

U.S. PATENT DOCUMENTS

| | | | | |
|---|---|---|---|---|
| 797,474 | A | | 8/1905 | Walker |
| 1,657,243 | A | | 1/1928 | Daniels |
| 2,354,801 | A | | 8/1944 | De Huff |
| 2,477,163 | A | | 7/1949 | Barnett |
| 2,611,160 | A | | 9/1952 | Hanesse |
| 3,031,727 | A | | 5/1962 | Nesbitt |
| 3,184,800 | A | | 5/1965 | Nelson |
| 3,333,875 | A | | 8/1967 | Tracy |
| 3,423,898 | A | | 1/1969 | Tracy |
| 3,749,428 | A | | 7/1973 | Hustead |
| 3,967,908 | A | | 7/1976 | Snow |
| 4,015,399 | A | | 4/1977 | Prins |
| 4,410,294 | A | | 10/1983 | Gilb et al. |
| 4,414,785 | A | | 11/1983 | Howell |
| 4,449,335 | A | * | 5/1984 | Fahey ..... 52/92.2 |
| 4,669,235 | A | | 6/1987 | Reinen |
| 4,976,085 | A | | 12/1990 | Krueger |
| 5,109,646 | A | | 5/1992 | Colonias et al. |
| 5,230,198 | A | | 7/1993 | Callies |
| 5,335,469 | A | | 8/1994 | Stuart |
| 5,561,949 | A | | 10/1996 | Knoth |
| 5,572,840 | A | * | 11/1996 | Fast et al. ..... 52/213 |
| 5,857,295 | A | * | 1/1999 | Mikawa ..... 52/92.2 |

(Continued)

*Primary Examiner* — Mark Wendell
*Assistant Examiner* — Keith Minter
(74) *Attorney, Agent, or Firm* — DeLio, Peterson & Curcio LLC; David R. Pegnataro

(57) ABSTRACT

A self-adjusting heel joint connector for securing roof structural members, without the need for a conventional birdsmouth cut or toe-nailing. The connector is slideably insertable between the bottom of a preset rafter and the top of a supporting wall plate at a heel joint and is capable of self-adjusting to a precise preset rafter pitch. The connector includes a support member securable to the top of the supporting wall plate, and a framing member freely rotatable with respect to the support member about a swivel joint. The framing member is securable to the angled rafter and an adjacent joist/tie member, and includes a pair of legs positioned at approximately a right angle in which the rafter sits. The framing member includes through-holes for securing the connector to an angled rafter and an adjacent joist/tie member, and may be utilized as a guide for proper fastener placement by a craftsman in the field. The connector provides restraint from lateral movement and uplift, and provides for full vertical rafter load transfer through the connector directly to the top of the supporting wall plate, while transferring thrust force in the rafter to the adjacent joist/tie member.

20 Claims, 13 Drawing Sheets

(56) References Cited

U.S. PATENT DOCUMENTS

| | | | | |
|---|---|---|---|---|
| 6,176,057 | B1 * | 1/2001 | Bouchet et al. | 52/514 |
| 6,295,781 | B1 | 10/2001 | Thompson | |
| 6,837,019 | B2 | 1/2005 | Collie | |
| 6,922,967 | B2 | 8/2005 | Collie | |
| 6,931,813 | B2 | 8/2005 | Collie | |
| 7,316,098 | B1 | 1/2008 | Sackett | |
| 7,707,785 | B2 * | 5/2010 | Lin | 52/92.2 |
| 7,891,144 | B2 * | 2/2011 | Gilstrap et al. | 52/92.2 |
| 7,918,054 | B2 * | 4/2011 | Grafton et al. | 52/92.3 |
| 7,971,410 | B2 | 7/2011 | Jerke | |
| 7,987,636 | B2 | 8/2011 | Hunt | |
| 8,590,256 | B2 | 11/2013 | Kawai et al. | |
| 8,850,774 | B2 * | 10/2014 | Kempf et al. | 52/640 |
| 2006/0059794 | A1 * | 3/2006 | Gilstrap et al. | 52/90.1 |
| 2006/0150564 | A1 | 7/2006 | Dufault | |
| 2008/0244993 | A1 | 10/2008 | Crumley | |
| 2011/0225924 | A1 | 9/2011 | Carbonaro et al. | |

* cited by examiner

SELF-ADJUSTING HEEL JOINT CONNECTOR

BACKGROUND OF THE INVENTION

1. Field of the Invention

The present invention relates to a connector for making a structural connection between a plurality of structural members joined at an angle. Specifically, the present invention relates to a self-adjusting heel joint connector for securing a roof rafter, ceiling joists/ties, and supporting walls, without the need for a conventional birdsmouth cut. The connector includes a swivel joint to allow for adjustment to a precise preset roof pitch for transferring vertical load through the connector directly to the top of the supporting wall plate and has the capability of transferring rafter thrust force to the joist/tie member. The framing member of the connector may further act as a guide for proper fastener placement to transfer rafter thrust force to the joist/tie member. The design of the present invention forms a stable unit which provides greater lateral structural stability, while saving construction time and costs.

2. Description of Related Art

Light frame building construction is the predominant method of construction in the residential and light commercial construction market. In light frame construction, a birdsmouth joint or cut is a woodworking joint that is generally used to connect a roof rafter to the top plate of a supporting wall. It is an indentation cut into the rafter which consists of a "seat cut" (the face of which rests on the top plate) and a "heel cut" or "plumb cut" (the face of which lies parallel to the supporting wall), forming a shape resembling a bird's mouth. The indentation should not extend unsupported on the interior in order to maintain the structural integrity of the rafter because the unsupported section can split along the grain of the wood. Saw blade overrun at the birdsmouth cut can also cause damage to the rafter. The depth of a rafter cut varies according to the desired roof pitch.

The "heel" joint is generally fastened with nails by toe-nailing the rafter from the side into the top plate below. Toe-nailing of the rafter to the wall plate often also leads to splitting of the rafter.

Many different connectors are used in the art for joining structural members for building construction, and these different connectors are designed to secure rafters to the adjoining wall of a building structure, often at a unique angle of attachment. The connectors are typically provided with through-holes for fasteners to be driven through the connector and into the side faces of the structural members being connected. In addition, other connectors for securing a rafter to a supporting wall must be designed for withstanding upward and lateral loads developed by high winds, which can differ by geographic location, and may include hurricane forces.

The prior art has provided numerous configured connectors to secure structural members to one another, particularly in the area of rafter-joist-wall attachments; however, each has various disadvantages which impede the connector's effectiveness.

For example, U.S. Pat. No. 2,354,801 issued to De Huff on Aug. 1, 1944, entitled "RAFTER SEAT", discloses a rafter seat comprising a sheet of metal bent to form a pair of horizontally disposed spaced base plate portions for seating on the upper face of a plate structure or the like; a rafter seat portion forming a joist supporting flat surface inclined with relation to said base plate portions; and a pair of vertically extending intermediate wall portions connecting said seat portion to the respective plate portions.

De Huff's connector must be in place at the heel joint prior to placing the rafter, and therefore cannot adjust to accommodate a preset roof pitch. Further, the sloping surface is an integral part of the connector and a separate connector would have to be made for each different roof pitch. The connector also does not allow for direct full surface contact between the bottom of the rafter and the top of the supporting wall plate. There appears to be no provision for transferring rafter thrust force directly to the adjacent joist/tie to complete the structural system.

In U.S. Pat. No. 2,477,163 issued to Barnett on Jul. 26, 1949, entitled "TRUSS SHOE", a truss shoe for use with a joist and a rafter having an end face and a bottom face resting on said joist comprising a pair of parallel, spaced apart, elongated side plates of L shape and having vertical and horizontal portions and of sufficient extent to overlie parts of the side faces of said joist and said rafter; a horizontal saddle plate connecting upper edges of the horizontal portion of the side plates and extending therebetween to overlie the upper face of the joist; a second horizontal saddle plate connecting the side plates at the other end thereof and extending therebetween to overlie the upper face of the joist and coplanar with the first mentioned saddle plate; and a vertically disposed plate adjacent and above the second saddle plate and extending between and connecting the side plates to function as an abutment for the end face of the rafter, is taught.

The truss shoes may be applied and secured to opposite ends of the joist by bolts or nailing, and thereafter the rafters may be placed in position and secured by nailing to the joists. Alternatively, the truss shoes and rafters may all be assembled on the ground and then hoisted up and placed in position on the wall plates.

Barnett's design includes no lateral bracing to the wall and no connection to the wall plate, and is primarily made for a truss connection. As shown, the rafter is directly over the joist. The rafter pitch must be predetermined prior to truss fabrication, and there is no capability to adjust rafter pitch.

In U.S. Pat. No. 3,967,908 issued to Snow et al. on Jul. 6, 1976, entitled "CROSS TIE SADDLE BRACKET", a weld fabricated steel saddle bracket having an elongated angle member with a portion thereof adapted to abut the side of the top wall plate of a building and another portion thereof adapted to lie on the top of the top wall plate and two identical right angle members having horizontal portions welded to the top portion of the elongated angle member so that the side edges thereof are in planar alignment with the side portion of the elongated member and the ends thereof lie flush with the ends of the elongated member, and the two identical right angle members having vertical portions projecting upwardly in parallel spaced apart relationship from the top surface of the top wall plate to form a saddle to receive the cross tie members and roof rafters of the building, is taught.

Snow's connector is a welded connector having no adjustable seat, and the rafter must be cut for a seat to adjust the roof pitch. There is also no provision for transferring rafter thrust force to an adjacent joist/tie member.

In U.S. Pat. No. 5,230,198 issued to Callies on Jul. 27, 1993, entitled "VARIABLE PITCH CONNECTOR", a connector for connecting a bearing member, having top, bottom, and side faces, with an inclined member having top, bottom and side faces, said connector comprising: a base having a first edge and means for connecting said base to said bearing member; a cradle member having a connection end, a free end, a bottom and a pair of sides extending upwardly at right angles from said bottom and configured to receive said inclined member, said cradle member being integrally connected at said connection end to said base along said first edge and including means for connecting said cradle to said inclined member; and a separate support member, connected to said base for supporting said cradle member, is taught.

Callies' connector must be in place prior to placing the rafter, and requires hammering to force the connector to adjust its riser seat for required pitch. Further, the connection is field bent during hammering. Callies' connector includes a separate support member which is hammered between the cradle member and the top of the supporting wall plate to adjust the pitch of the cradle member. This support member is wider than the cradle member and therefore projects on both sides of the rafter, prohibiting flush contact with an adjacent joist/tie member. Moreover, the cradle member sides also prohibit the rafter from being flush with the joist/ties, which prevents the proper fastening needed to transfer the rafter thrust load to the joist/ties. In addition, one end of the cradle member supporting the inclined member bears on the line edge of the wall plate. Building code requirements are that the load be transferred to the top of the wall plate for a minimum of 1½" bearing, which is not possible with Callies' connector.

In U.S. Pat. No. 5,335,469, issued to Stuart on Aug. 9, 1994, entitled "RAFTER TO PLATE CONNECTION", a rafter to plate connection in a wood frame building including wood top plate, and a wood rafter joined by a variable pitch connector including a rafter seat for receiving a portion of the wood rafter, a fixed base member affixed to the outside edge of the wood top plate, first and second side members joined to opposite sides of the wood rafter, and an adjustable base member joined to the rafter seat along a bend line and having a lower end in contact with the upper surface of the wood top plate, is taught. Fasteners join the fixed base member to the outside edge of the wood top plate, the adjustable base member to the wood top plate and the wood rafter to the side members.

Similar to Callies' connector, Stuart's connector must be in place prior to placing the rafter, and requires hammering to force the connector to adjust its riser seat for required pitch. Further, the connection is field bent during hammering. As in Callies, the connector first and second side members prohibit the rafter from being flush with the joist/ties, which prevents the proper fastening needed to transfer the rafter thrust load to the joist/ties. One end of the rafter seat bears on the line edge of the wall plate, which does not allow for transfer of the vertical load directly to the top of the wall plate.

The present invention overcomes the disadvantages of the prior art by providing a heel joint connector that is self-adjusting to accommodate preset rafter pitches and provides for a code-required minimum of 1½" bearing between the bottom of the rafter and the top of the supporting wall plate, while transferring vertical load through the connector directly to the top of the supporting wall plate and transferring rafter thrust force to the adjacent joist/tie member, completing the structural system. Further, the framing member of the connector can be used as a guide by a craftsman in the field for proper placement of fasteners to transfer rafter thrust force to an adjacent joist/tie member.

Other advantages of the present invention include a reduction in the time required to fabricate each rafter, including but not limited to, handling, measuring, layout and omitting a birdsmouth cut in the rafter, as well as eliminating the need for conventional toe-nailing of the rafter to the supporting wall plate and field metal bending.

SUMMARY OF THE INVENTION

Bearing in mind the problems and deficiencies of the prior art, it is therefore an object of the present invention to provide a self-adjusting connector capable of adjoining the structural components at a heel joint in a building, including a rafter, joist/tie, and top wall plate, in a single connector and without the need for a conventional birdsmouth cut.

It is another object of the present invention to provide a self-adjusting connector which provides for transferring at least minimum code-required surface area between the bottom of a rafter and top of a supporting wall plate, without relying on a skilled craftsman to provide an accurate rafter cut.

It is another object of the present invention to provide a self-adjusting connector which is capable of adjusting to a precise preset rafter pitch setting from 2/12 to 12/12 for full vertical rafter load transfer through the connector directly to the top of the supporting wall plate.

A further object of the invention is to provide a self-adjusting connector which provides for increased lateral structural stability.

It is yet another object of the present invention to provide a self-adjusting connector which reduces the time required to fabricate each rafter, including but not limited to, handling, measuring, layout and cutting a birdsmouth in the rafter, as well as eliminating the need to bevel the top of the supporting wall plate.

It is still another object of the present invention to provide a connector which can be fabricated opposite hand, so that the layout of the rafters can butt each other at the ridge.

It is still another object of the present invention to provide a self-adjusting connector which eliminates all conventional toe-nailing of the rafter to the supporting wall plate, which often leads to wood splitting at the bearing surface of the birdsmouth cut.

It is still another object of the present invention to provide a self-adjusting connector which is easily adaptable to repair rafters at a heel joint of an existing structure.

It is still another object of the present invention to provide a self-adjusting connector with no projecting extended sections or protrusions that would interfere with placing adjacent members flush with each other, including joist/tie members or other connectors.

It is yet another object of the present invention to provide a self-adjusting connector which may be placed on and fastened to various materials, including wood, masonry, concrete or steel, with appropriate fasteners.

Is it yet another object of the present invention to provide a connector which can serve as a guide for proper placement of fasteners to transfer rafter thrust force to an adjacent joist/tie member.

Still other objects and advantages of the invention will in part be obvious and will in part be apparent from the specification.

The above and other objects, which will be apparent to those skilled in the art, are achieved in the present invention which is directed to a heel joint connector for connecting structural members in building roof structures, comprising: a support member having a flat base surface, the flat base surface including a plurality of through-holes for fasteners to secure the support member to a top surface of a supporting wall plate, the supporting wall plate supported by an exterior stud; a framing member having a vertical leg and a horizontal leg, the horizontal leg attached to or integral with the vertical leg and positioned at approximately a right angle to the vertical leg, the vertical leg including a plurality of through-holes for fasteners to secure the framing member to a rafter and a joist/tie; and a swivel joint offset from the support member flat base surface, wherein the framing member is rotatably secured to the support member about the swivel joint and freely rotatable within a predetermined rafter pitch range.

The heel joint connector is self-adjustable to a precise preset rafter pitch angle when the connector is slideably inserted between a bottom surface of the rafter and the supporting wall plate top surface and moved laterally along the supporting wall plate top surface in the direction of an outside face of the exterior stud until fully contacting the rafter bottom surface and the supporting wall plate top surface.

The framing member horizontal leg may have a tab extending laterally in the direction of an outside face of the exterior stud, the tab forming a plane with the framing member horizontal leg and capable of being folded in the direction of the exterior stud, the tab including a plurality of through-holes for fasteners to secure the tab to an exterior side of the supporting wall plate and the outside face of the exterior stud.

The support member may include at least two extended portions integral with or attached to, and extending from, the flat base surface and disposed in the direction of the swivel joint. The at least two extended portions and the flat base surface may form a triangular cross-section. Alternatively, the at least two extended portions may be positioned plumb and disposed from a midpoint of the flat base surface. The support member may instead include one extended portion integral with or attached to, and extending from, the flat base surface and disposed in the direction of the swivel joint.

The framing member vertical leg may include at least one placement tooth, the at least one placement tooth capable of piercing the rafter at a predetermined depth not exceeding the depth of the rafter.

The framing member vertical leg may include a positioning tab integral with or attached to the framing member vertical leg, the positioning tab forming a plane with the framing member horizontal leg and located offset a predetermined distance from the framing member horizontal leg along the plane.

The framing member vertical leg plurality of through-holes may be oriented in a plurality of rows along a longitudinal axis of the framing member vertical leg forming a substantially pyramidal shape. The vertical leg plurality of through-holes may be spaced so that each through-hole is equidistant from each adjacent through-hole in the same row and each row is equidistant from each adjacent row, wherein the distance between adjacent through-holes in the same row is not equal to the distance between adjacent through-holes in adjacent rows. The bottom row may be spaced a predetermined distance from a bottom edge of the framing member vertical leg, and the through-hole at the end of each row may be spaced a predetermined distance from the adjacent edge of the framing member vertical leg, wherein the distance between the through-hole at the end of each row and the adjacent edge of the framing member vertical leg increases in each row beginning from the bottom row. The vertical leg plurality of through-holes may be spaced so that as the framing member rotates about the swivel joint to adjust to a precise preset rafter pitch, the plurality of through-holes remain positioned perpendicular to the rafter thrust force and the tension force in the joist/tie, to allow for transfer of the rafter thrust force to the joist/tie when fasteners are driven therethrough.

The support member and framing member may each be fabricated from a single sheet of gage steel, formed from cast steel or formed from forged metal, and each of the support member, framing member and swivel joint may include a corrosion-preventing protective coating.

The swivel joint may be capable of receiving a pin connector inserted therethrough, wherein the pin connector does not protrude beyond either end of the swivel joint and the pin connector is rotatably secured within the swivel joint such that the pin connector remains in place during rotation of the framing member about the swivel joint. The swivel joint may be comprised of a plurality of mounting loops, at least one of the plurality of mounting loops attached to or integral with each of the support member and the framing member horizontal leg, the plurality of mounting loops mutually aligned to allow for insertion of the pin connector therethrough.

The present invention is further directed to a method for connecting structural members in building roof structures comprising the steps of: providing a support member having a flat base surface, the flat base surface including a plurality of through-holes for fasteners to secure the support member to a top surface of a supporting wall plate, the supporting wall plate supported by an exterior stud; providing a framing member having a vertical leg and a horizontal leg, the horizontal leg attached to or integral with the vertical leg and positioned at approximately a right angle to the vertical leg, the vertical leg including a plurality of through-holes for fasteners to secure the framing member to a rafter and a joist/tie; and providing a swivel joint offset from the support member flat base surface, wherein the framing member is rotatably secured to the support member about the swivel joint and freely rotatable within a predetermined rafter pitch range, and wherein the support member, framing member and swivel joint integrally form a heel joint connector. The method further includes the steps of slideably inserting the heel joint connector between a bottom surface of the rafter and the supporting wall plate top surface and moving the heel joint connector laterally along the top of the supporting wall plate in the direction of an outside face of the exterior stud until fully contacting the rafter bottom surface and the supporting wall plate top surface at a predetermined rafter pitch angle; securing the framing member to the rafter and the joist/tie using fasteners driven through the vertical leg plurality of through-holes into the rafter and joist/tie; and securing the support member to the supporting wall plate top surface using fasteners driven through the flat base surface plurality of through-holes into the supporting wall plate top surface.

The framing member horizontal leg may include a tab extending laterally in the direction of an outside face of the exterior stud, the tab forming a plane with the framing member horizontal leg and capable of being folded in the direction of the exterior stud, the tab including a plurality of through-holes for fasteners to secure the tab to an exterior side of the supporting wall plate and the outside face of the exterior stud, and the method may further include the steps of: folding the horizontal leg tab in the direction of the exterior stud; and securing the horizontal leg tab to the exterior side of the supporting wall plate and the outside face of the exterior stud using fasteners driven through the horizontal leg tab plurality of through-holes into the exterior side of the supporting wall plate and the outside face of the exterior stud.

In another aspect, the present invention is directed to a framing member for connecting structural members in building roof structures, comprising: a vertical leg including a plurality of through-holes for marking the intended location of fasteners on a face of a rafter to secure the rafter to an adjacent joist/tie, the plurality of through-holes oriented in a plurality of rows along a longitudinal axis of the vertical leg and forming a substantially pyramidal shape; and a horizontal leg attached to or integral with the vertical leg and positioned approximately at a right angle to the vertical leg, wherein the vertical leg and horizontal leg are placed so that the rafter sits on a top surface of the horizontal leg and the vertical leg is flush with a surface of the rafter opposite the joist/tie.

The vertical leg plurality of through-holes may be spaced so that as the framing member vertical leg is placed flush with a surface of the rafter opposite the joist/tie at a precise preset rafter pitch, the plurality of through-holes are positioned perpendicular to the rafter thrust force and the tension force in the joist/tie to allow for transfer of the rafter thrust force to the joist/tie when fasteners are driven therethrough.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
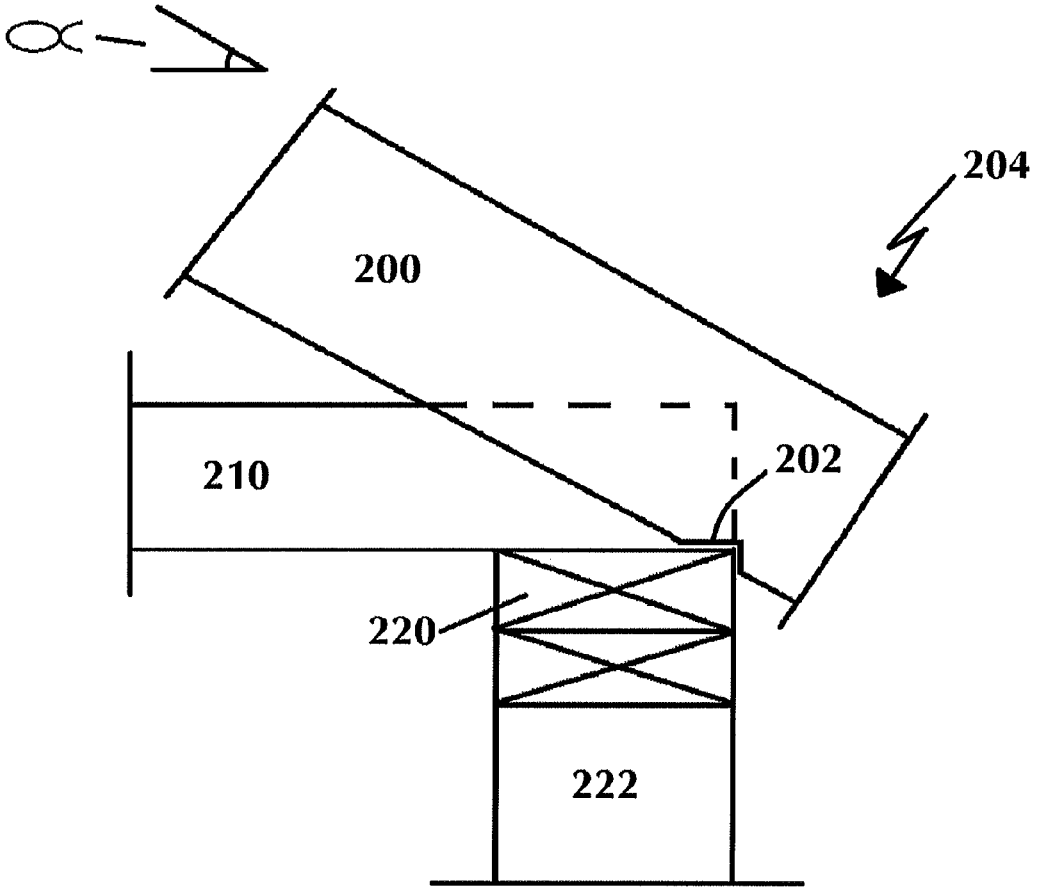
FIG. 1 (PRIOR ART)
FIG. 1 depicts a heel joint and a conventional birdsmouth cut or seat in a rafter of the prior art.

In describing the preferred embodiment of the present invention, reference will be made herein to FIGS. 1-14 of the drawings in which like numerals refer to like features of the invention.

The present invention addresses the roof to wall heel connection in modern housing construction, more particularly wood frame construction, and specifically the roof heel joint (where the roof bears on the supporting wall). It is at this connection that dead & live loads, plus wind/hurricane & seismic forces are transferred.

The joint at the intersection of the roof rafter, joist/tie, blocking, wall plate and wall studs is commonly referred to as the "heel" joint. The heel joint is one of the most significant joints in the entire building structure, and represents the point where the roof's dead and live loads are combined with wind/hurricane loads, exposing the heel joint to uplift and overturning forces in all directions. It is at this junction that the aforementioned loads are transferred to the exterior supporting, bracing and shear walls.

Conventionally, mating an angled rafter securely with the top wall plate at the heel joint is achieved using a birdsmouth cut or seat in the rafter. The standard construction is to notch the bottom of the rafter with an angular cut to accommodate the selected roof pitch and having toe-nails to connect to the top wall plate. To assure proper fit, the joint requires a skilled carpenter for accuracy to provide a cut allowing for full surface contact between the bottom of the rafter and the top of the supporting wall plate. Further, "toe-nailing" of the rafter to the supporting wall plate is required, which leads to splitting at the rafter load bearing surface. These conditions weaken the carrying capacity of the joint.

The present invention provides a self-adjusting heel joint connector which provides for full load transfer from the bottom of a preset rafter to the top of the supporting wall plate without the need for a conventional birdsmouth cut or "toe-nailing" of the rafter to the supporting wall plate, which is generally performed in the prior art. The present invention has the capability to self-adjust to the precise preset pitch of the rafter. The design of the connector is such that the connector can provide for a pitch range of 4/12 to 12/12 (and the infinite fractions in between) for a conventional 2×4 wall plate, and 2/12 to 12/12 (and the infinite fractions in between) for a conventional 2×6 wall plate. Further, the unique design is such that the vertical rafter load is transferred through the connector directly to the top of the supporting wall plate over a uniform distributed area, while the rafter thrust force is transferred to the adjacent joist/tie member, providing a complete structural system.

The self-adjusting heel joint connector of the present invention includes a framing member rotatably secured to a support member about a swivel joint. The framing member is freely rotatable about the swivel joint with respect to the support member within a predetermined rafter pitch range, which allows the heel joint connector to self-adjust to the precise pitch of the rafter during the placing process, providing for full surface contact and direct vertical load transfer to the supporting wall plate. In a preferred method, the heel joint connector is slidably inserted by hand between the bottom of a rafter (which has already been set in position) and the top of a supporting wall plate, and moved laterally along the top of and perpendicular to the supporting wall plate in the direction of the outside face of the supporting stud, until fully contacting both the bottom of the rafter and the top of the supporting wall plate at the preset rafter pitch.

During placement, the rafter is fit between vertical and horizontal legs of the framing member such that the vertical leg is flush with a surface of the rafter opposite the adjacent joist/tie and the rafter sits substantially flush on a top surface of the horizontal leg. The framing and support members directly support the rafter vertical load and fasteners driven through the connector into the rafter and adjacent joist/tie member provide a single structural unit with greater lateral stability and the capability to resist and transfer rafter thrust force to the joist/tie member. The width of the horizontal leg may vary to accommodate the width of the rafter which is supported by and secured to the framing member. Once the heel joint connector has been slid into place, the framing member may be temporarily held in place by placement teeth which pierce the rafter at a predetermined distance. The framing member is then secured to the rafter and adjacent joist/tie member using through-fasteners and the support member is secured to the top of the supporting wall plate using through-fasteners. The framing member horizontal leg may further include a tab which is capable of being folded in the direction of the exterior face of the supporting wall plate and the outside face of the exterior stud and is secured thereto using through-fasteners.

Horizontal fasteners are driven through a plurality of through-holes in the framing member vertical leg, through the rafter and into the adjacent joist/tie. All fasteners used to secure the rafter to the adjacent joist/tie member are placed perpendicular to the framing member vertical leg, which further increases the heel joint connector's load capacity. The support member is also secured by the craftsman to the supporting wall plate using fasteners driven through a plurality of through-holes in the support member. These fasteners provide stability to the connector of the present invention and provide restraint from lateral movement and uplift. Preferably, the framing member, support member, swivel joint and all fasteners have a corrosion-preventing protective coating on their respective surfaces.

Certain terminology is used herein for convenience only and is not to be taken as a limitation of the invention. For example, words such as "upper," "lower," "left," "right," "horizontal," "vertical," "upward," and "downward" merely describe the configuration shown in the drawings. For purposes of clarity, the same reference numbers will be used in the drawings to identify similar elements.

Referring now to FIG. 1, a typical heel joint 204 of the prior art is shown, with a birdsmouth cut or seat 202 in a rafter 200. Rafter 200 is positioned at angle $\alpha$ to top wall plate 220. A birdsmouth cut 202 is an L-shaped notch with a horizontal and vertical component sized to fit on a top wall plate 220 (shown here as a double plate), which is supported by exterior stud 222. By virtue of the birdsmouth cut, the angled rafter has significantly more than a linear contact with the top wall plate. The surface area of the weight-bearing contact (the horizontal component of the birdsmouth cut) is extended by the birdsmouth cut. Adjacent joist/tie 210 (shown behind rafter 200 for illustrative purposes) extends laterally from top wall plate 220. At each rafter-joist-exterior stud wall junction, blocking (not shown, for clarity) is also typically attached. The rafter 200 is fastened to the adjacent joist/tie member 210 using fasteners (not shown) at various locations, as determined by design and building code and set by the craftsman in the field, and "toe-nailing" of the rafter to the supporting wall plate 220 is typically performed.

Figure 2:
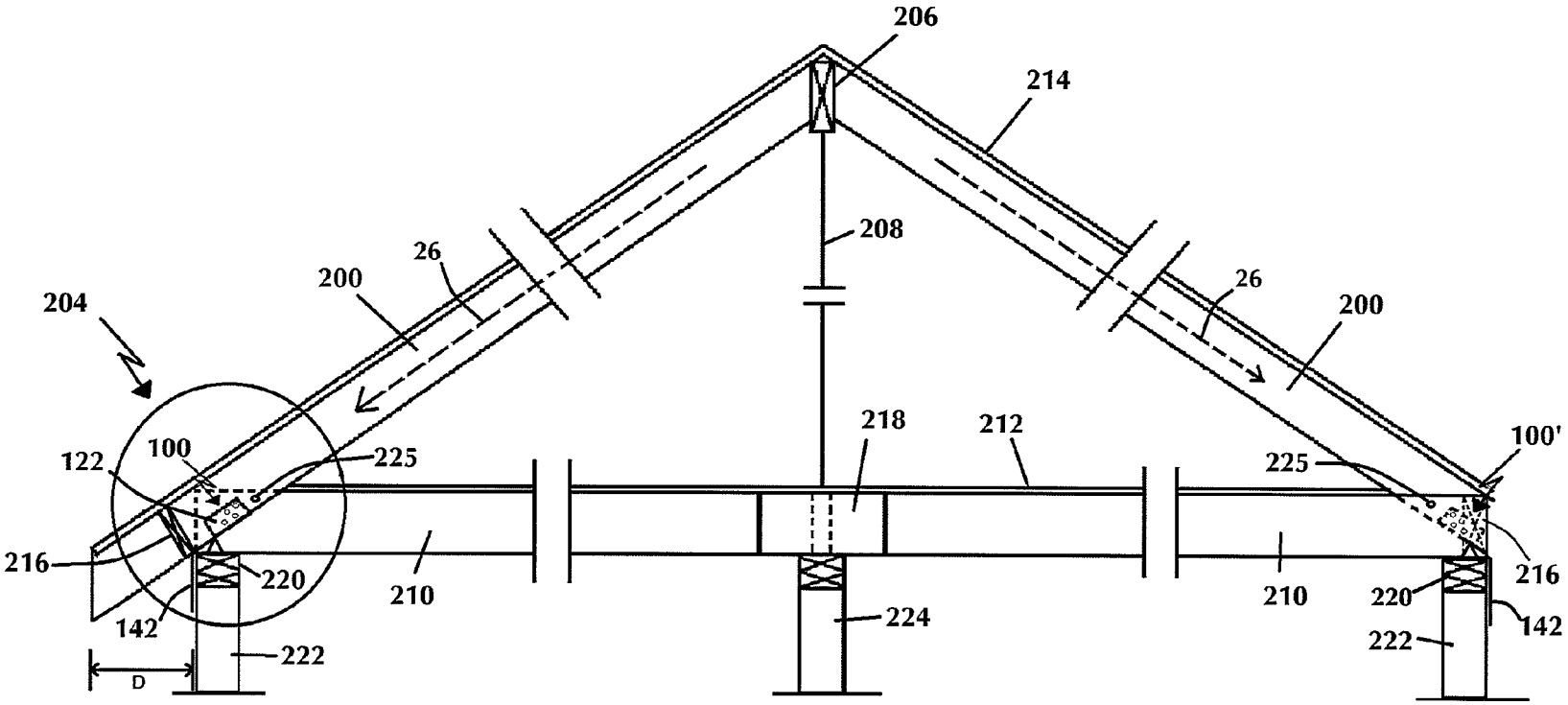
FIG. 2 depicts a conventional framing layout including the self-adjusting heel joint connector of the present invention.

FIG. 2 depicts a conventional roof framing layout, including the self-adjusting heel joint connector 100 of the present invention. For exemplary purposes, FIG. 2 depicts two conventional roof designs in one building structure. On the left half of the structure is an overhanging roof design, where rafter 200 extends beyond the exterior stud 222 by an arbitrary, predetermined distance D. Alternatively, a conventional roof framing design may be a flush mounted design, wherein the rafter does not extend beyond the exterior stud, as shown on the right half of the structure in FIG. 2. Normally, either one design or the other would be used for a single construction; however, the combination of the two simultaneously in a single structure is also possible. Other roof framing designs may also be accommodated by the connector of the present invention.

As shown in FIG. 2, rafters 200 extend at an angle from a top wall plate 220, shown here as a double plate, and are connected at an opposite end by a ridge board or beam 206. Temporary support 208 supports ridge 206. A rafter thrust force 26 emanates from the ridge 206 in the direction of the top wall plate 220, parallel to the grain of the wood rafter. Top wall plate 220 is generally supported by exterior stud 222. Adjacent joists/ties 210 extend horizontally from top wall plate 220. During placement of rafter 200, an erection fastener 225 is placed to tightly secure rafter 200 to joist/tie 210. Joist/tie 210 may be extended in length to offset splice member 218. Joist/tie 210 may further be supported by an interior partition 224, if such support is needed. Blocking 216 is supported perpendicular to the angled rafter 200 in an overhanging roof design (as in the left half of the structure), and perpendicular to the joist/tie member 210 in a flush mounted design (as in the right half of the structure), and is secured between each rafter and joist/tie. As shown in FIG. 2, flooring 212 may be installed on top of joist/tie 210, and structural roof sheathing 214 covers the rafters 200.

FIG. 2 further shows one embodiment of the self-adjusting heel joint connector 100 of the present invention, which has been slideably inserted and secured at heel joint 204. Heel joint connector 100 is designed to attach rafter 200, joist/tie 210, top wall plate 220, and exterior stud 222 in a single, self-adjusting construction design. As shown, the heel joint connector 100 has been slideably inserted and secured at the heel joint 204 between the bottom of rafter 200 and top wall plate 220 such that the vertical leg 122 of the framing member of the connector is in the foreground of FIG. 2 and the connector is fastened to rafter 200 and adjacent joist/tie 210, which is behind rafter 200.

As further shown in FIG. 2, preferably, a second self-adjusting heel joint connector 100' of the present invention, which has been fabricated "opposite hand," is slideably inserted and secured at the heel joint on the opposing side of the building structure, which in FIG. 2 includes a flush mounted design. The framing member of the heel joint connector of the present invention is capable of being fabricated "opposite hand," which allows for the joist/tie members 210 to be aligned in the building structure and abut, and splice member 218 is then added. As shown in FIG. 2, a second heel joint connector 100' is slideably inserted and secured at the heel joint such that vertical leg of the framing member of the connector is behind rafter 200 and fastened to rafter 200 and adjacent joist/tie 210, which is in the foreground of FIG. 2. The rafter thrust forces 26 at each end of the building structure are transferred to the adjacent joist/tie members, which are aligned and connected by splice 218 to cancel out the opposing tension forces to complete the structural system. Whereas in a conventional framing layout of the prior art, the joist/tie members may overlap, which prevents the rafters from directly butting each other at the ridge, causing an eccentric load. Further, having the heel joint connectors directly in line on both sides of the structure and connected by a joist/tie splice member 218, as in FIG. 2, eliminates the need for permanent roof ridge supports, thus allowing for full open, unobstructed useable living space.

Figure 3:
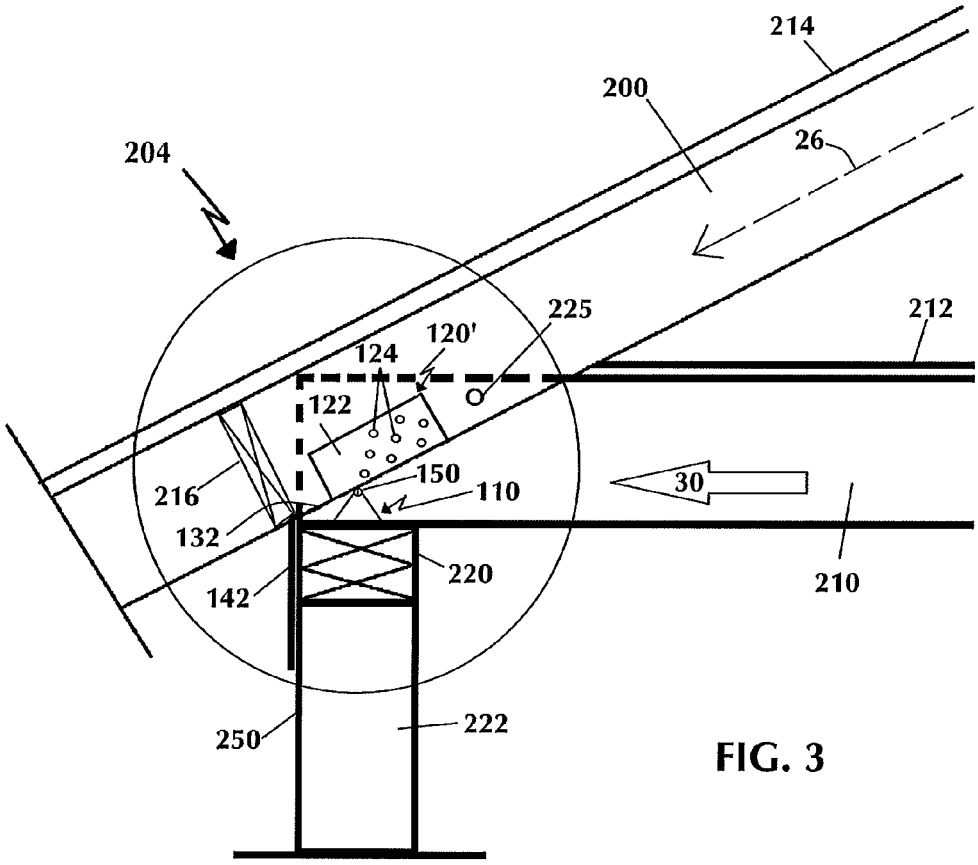
FIG. 3 depicts a magnified view of the heel joint 204 of FIG. 2 including the self-adjusting heel joint connector of the present invention.

FIG. 3 shows a magnified view of the heel joint 204 of FIG. 2, in which the heel joint connector of the present invention has been slideably inserted and secured at heel joint 204 in the direction of arrow 30. As shown in FIG. 3, the self-adjusting heel joint connector of the present invention includes a framing member 120' secured to rafter 200 at a precise preset pitch using fasteners (not shown) driven through a plurality of through-holes 124. Framing member 120' is freely rotatable (prior to and during placement) and rotatably secured about swivel joint 150 to a support member 110 secured to the top of supporting wall plate 220 using fasteners driven through a plurality of through-holes (not shown). Framing member 120' includes a vertical leg 122 and a horizontal leg 132 having a tab 142 which is field folded in the direction of the exterior face 250 of exterior stud 222 and secured to the side of top wall plate 220 and stud 222 using fasteners (not shown). Vertical leg 122 is flush with the surface of the rafter 200 opposite joist/tie member 210, and rafter 200 is supported by horizontal leg 132. By also securing the connector to the side of the supporting wall plate 220 and stud 222 using tab 142, additional anchorage is created against uplift forces.

Figure 4:
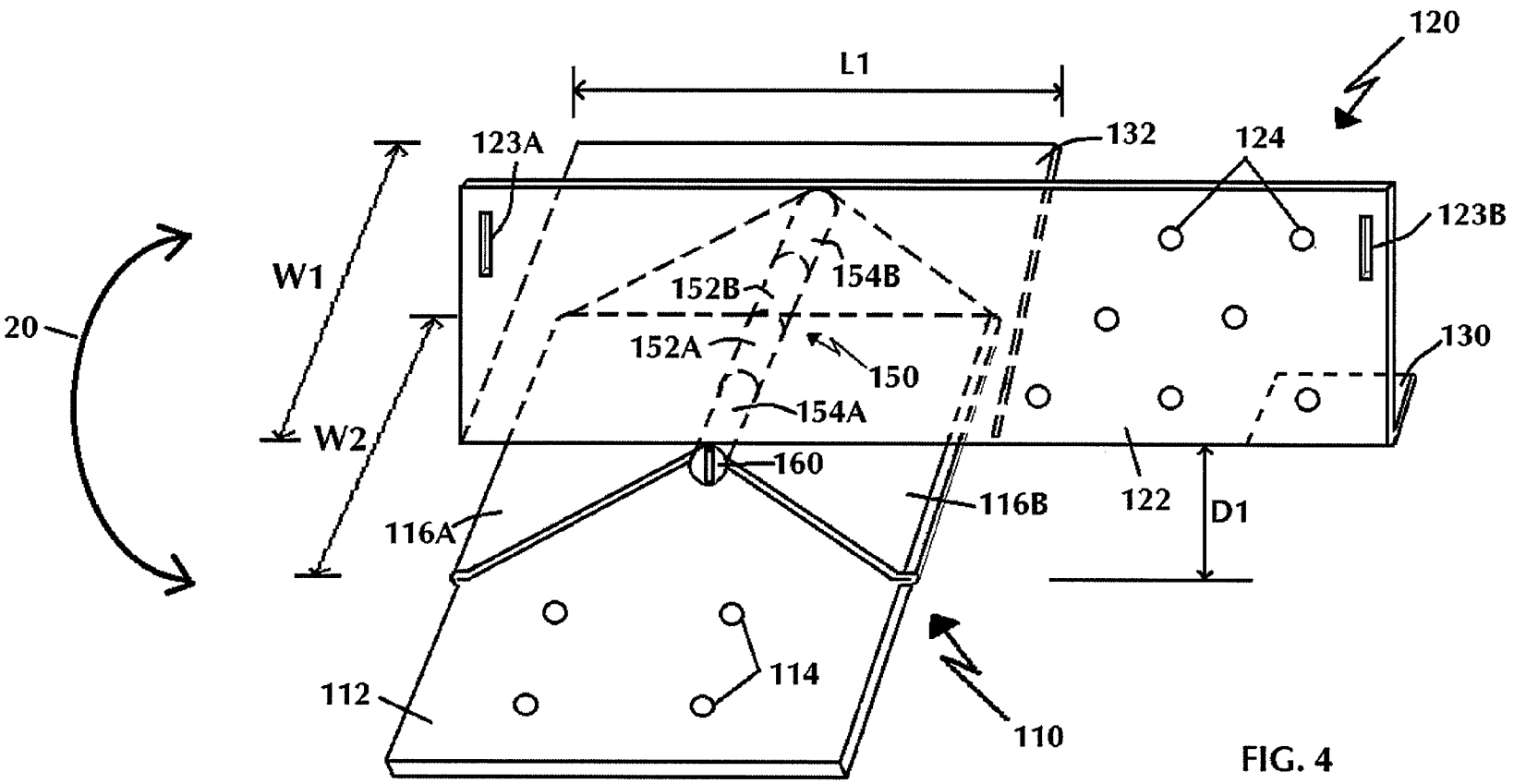
FIG. 4 depicts a perspective view of one embodiment of the self-adjusting heel joint connector of the present invention, wherein the framing member and support member are each formed from bent sheet metal.

FIG. 4 shows a perspective view of one embodiment of the self-adjusting heel joint connector of the present invention. As shown in FIG. 4, the self-adjusting heel joint connector includes a framing member 120 rotatably secured to a support member 110 about a swivel joint 150. The individual components of the self-adjusting heel joint connector are preferably each fabricated from a flat section of light gage metal steel, or other solid, bendable material resilient enough to attach the structural members for building construction and to withstand enhanced load forces. Alternatively, each of the support member or framing member may be fabricated from materials other than light gage steel, such as cast steel, forged metal or the like, so long as the separate components are attachable in a structurally sound manner that ultimately performs the function of the heel joint connector as claimed. The attachment of the structural members (rafter, joist/tie, wall plate, and exterior stud) is preferably achieved by employing fasteners, such as screws, nails, bolts and the like, driven through pre-punched through-holes in the framing member and support member, respectively, and into the face of the rafter and the top of the supporting wall plate and exterior stud.

Figure 7:
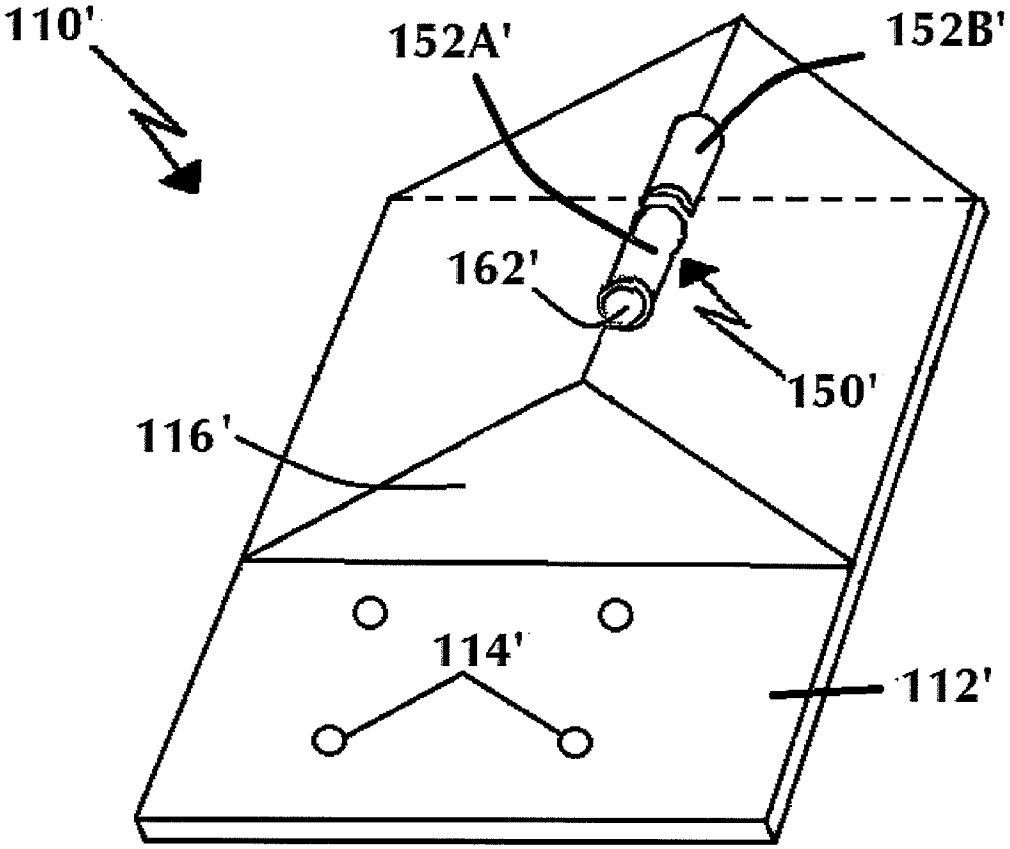
FIG. 7 depicts a perspective view of another embodiment of the support member of the self-adjusting heel joint connector of the present invention, wherein the support member is formed from forged metal or cast steel.

As depicted in FIG. 4, support member 110 has a flat base surface 112 for securing the support member to a top supporting wall plate (not shown). The support member for the swivel joint may include extended portions integral with or attached to, and extending from, the flat base surface 112 and disposed in the direction of the swivel joint 150, to offset the swivel joint from the flat base surface. As shown in FIG. 4, support member 110 includes side extended portions 116*a*, 116*b* having a width W2 which are integral with the flat base surface 112 and extend from opposing edges of the flat base surface in the direction of swivel joint 150 to form a triangular cross-section. This enables swivel joint 150 to be offset an arbitrary distance D1 from the flat base surface 112 of the support member 110, and allows for free rotation of the framing member 120 about swivel joint 150 in the direction of arrow 20 during placement of the heel joint connector. If the support member were formed from forged metal or cast steel, instead of a flat sheet of gage metal steel, as shown in FIG. 4, the cross-section of the support member, while still triangular, may instead be solid, as shown in FIG. 7.

Figure 8:
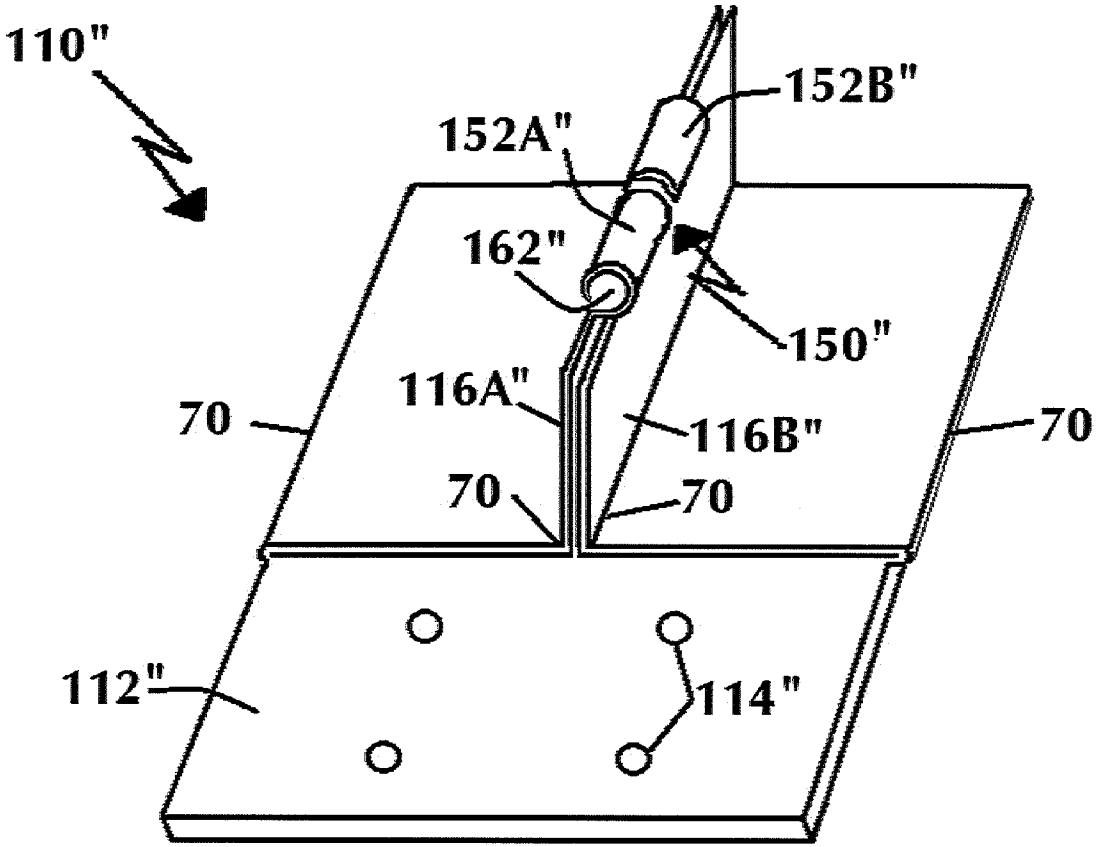
FIG. 8 depicts a perspective view of yet another embodiment of the support member of the self-adjusting heel joint connector of the present invention, wherein the support member includes two extended portions integral with the flat base surface, positioned plumb and disposed from a midpoint of the flat base surface in the direction of the swivel joint, and wherein the support member is formed from bent sheet metal.
Figure 9:
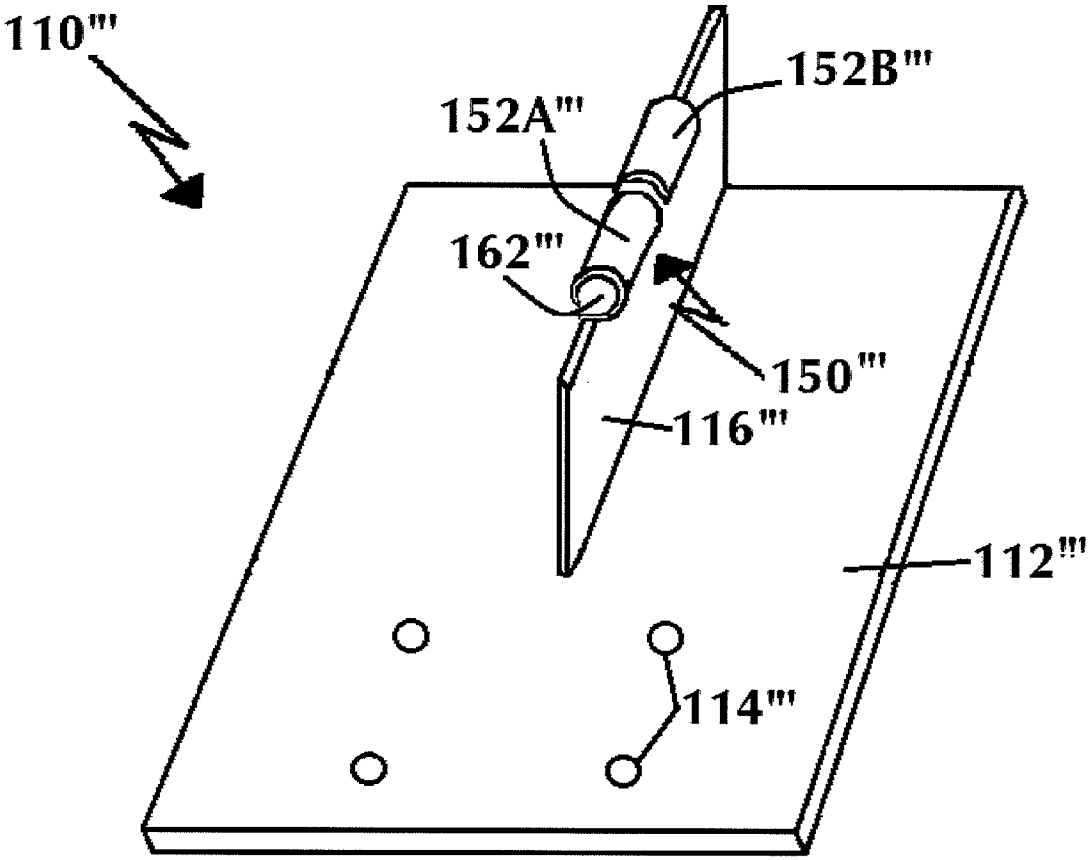
FIG. 9 depicts a perspective view of still another embodiment of the support member of the self-adjusting heel joint connector of the present invention, wherein the support member includes one extended portion perpendicular to the flat base surface and disposed from a midpoint of the flat base surface in the direction of the swivel joint, wherein the support member is formed from forged metal, cast steel or welded assembly.

Other embodiments of the support member of the present invention are not precluded, such as extended portions 116*a*", 116*b*" positioned plumb and disposed from a midpoint of the flat base surface 112", as shown in FIG. 8, or a single, solid extended portion 116" disposed from a midpoint of the flat base surface 112", as shown in FIG. 9. Those skilled in the art should appreciate that any orientation of the extended portion (s) disposed from the flat base surface of the support member may be used to carry out the same purposes of the present invention, so long as the extended portion(s) enable the swivel joint to be offset a distance from the flat base surface of the support member to allow for free rotation of the framing member with respect to the support member about the swivel joint, within a predetermined rafter pitch range, during placement of the connector.

Referring again to FIG. 4, the flat base surface 112 has a plurality of through-holes 114 allowing for fasteners (not shown) to be inserted or driven therethrough to secure the support member 110 to a top supporting wall plate (not shown). The support member may be placed and fastened to various materials, including wood, masonry, concrete, steel and the like. Preferably, the fasteners may be nails, screws, bolts or other similar fastening means, but may be any type of appropriate fastener to mate with the type of material comprising the top supporting wall plate. The number of through-holes required to secure the support member 110 to a top supporting wall plate is shown as four, for illustrative purposes only. Those skilled in the art should appreciate that the size, quantity and placement of fasteners (and corresponding through-holes) is design-dependent to ensure for maximum securing strength while minimizing lateral movement or racking, and the present invention is not limited to the size, number or location of through-hole placement, as shown.

As further depicted in FIG. 4, swivel joint 150 may be comprised of a plurality of mutually-aligned mounting loops 152*a*, 152*b*, 154*a*, 154*b* offset from flat base surface 112 and the bottom of framing member horizontal leg 132, respectively. Framing member 120 is freely rotatable about swivel joint 150 with respect to the support member 110 in the direction of arrow 20, within a predetermined rafter pitch range. This allows the heel joint connector to self-adjust to the precise pitch of the rafter during the placing process, providing for full surface contact and load transfer. The design of the connector is such that the connector can provide for a pitch range of 4/12 to 12/12 (and the infinite fractions in between) for a conventional 2×4 wall plate, and 2/12 to 12/12 (and the infinite fractions in between) for a conventional 2×6 wall plate.

As further shown in FIG. 4, framing member 120 has a vertical leg 122 and a horizontal leg 132, which is attached to or integral with vertical leg 122 and is positioned approximately at a right angle to vertical leg 122. A rafter (not shown) is preferably fit between the vertical and horizontal legs of the framing member such that the bottom of the rafter is substantially flush with and supported by the horizontal leg 132 and vertical leg 122 is substantially flush with the surface of the rafter opposite an adjacent joist/tie member. Framing member horizontal leg 132 has length L1 and width W1, and the width W1 of horizontal leg 132 is approximately equal to the width W2 of extended portions 116*a*, 116*b*. The width W1 of horizontal leg 132 may vary in accordance with the width of the rafter(s) which it supports; however, the width W2 of extended portions 116*a*, 116*b* will always be approximately equivalent to the width W1 of the horizontal leg 132. Alternatively, multiple rafters may also be supported by one framing member, wherein the rafters are positioned adjacent and flush with each other.

Vertical leg 122 has a plurality of through-holes 124 allowing for fasteners to be inserted or driven therethrough to secure the framing member 120 to a rafter and an adjacent joist/tie member. The number of through-holes required to secure the framing member to the rafter and joist/tie is shown as seven for illustrative purposes only, as the number of fasteners (and corresponding through-holes) needed may be more or less than seven, based upon the rafter thrust force.

The size, placement and spacing of the fasteners is crucial for providing the full intent of the heel joint connector of the present invention, which includes allowing for the rafter thrust force to be transferred to the adjacent joist/tie member. Presently, building codes provide information and tables stating the requirements for fastener size, layout, spacing, edge and end distance for given fastener sizes. It is then left to the craftsman in the field to interpret these requirements for each design loading condition, which leaves open the possibility of craftsman error and results in non-uniformity of positioning and spacing of fasteners and leads to splitting of the rafter, and further effects the required capacity to transfer thrust load.

To avoid this potential problem, advantageously, the self-adjusting heel joint connector of the present invention includes a plurality of through-holes which are pre-sized, pre-positioned and spaced on the framing member vertical leg so that as the connector framing member rotates about the swivel joint to self-adjust to the precise preset rafter pitch during placement of the connector, the position of the through-holes (and thereafter, the location of the fasteners) will correspondingly reposition to be perpendicular to the rafter thrust force (i.e. parallel to the grain of the wood) and the tension force in the joist/tie member, to allow for transfer of the thrust force to the adjacent joist/tie member when fasteners are driven therethrough. This results in a time savings in the field and, more so, prevents possible misinterpretation and layout errors by the craftsman.

Even if the conventional heel joint construction generally performed in the prior art is used (i.e. mating an angled rafter securely with the top wall plate at the heel joint using a birdsmouth cut or seat in the rafter and thereafter "toe-nailing" the rafter to the supporting wall plate), the provisions for transferring rafter thrust force to the joist/tie member must still be provided for, unless the ridge member is permanently supported.

Figure 14:
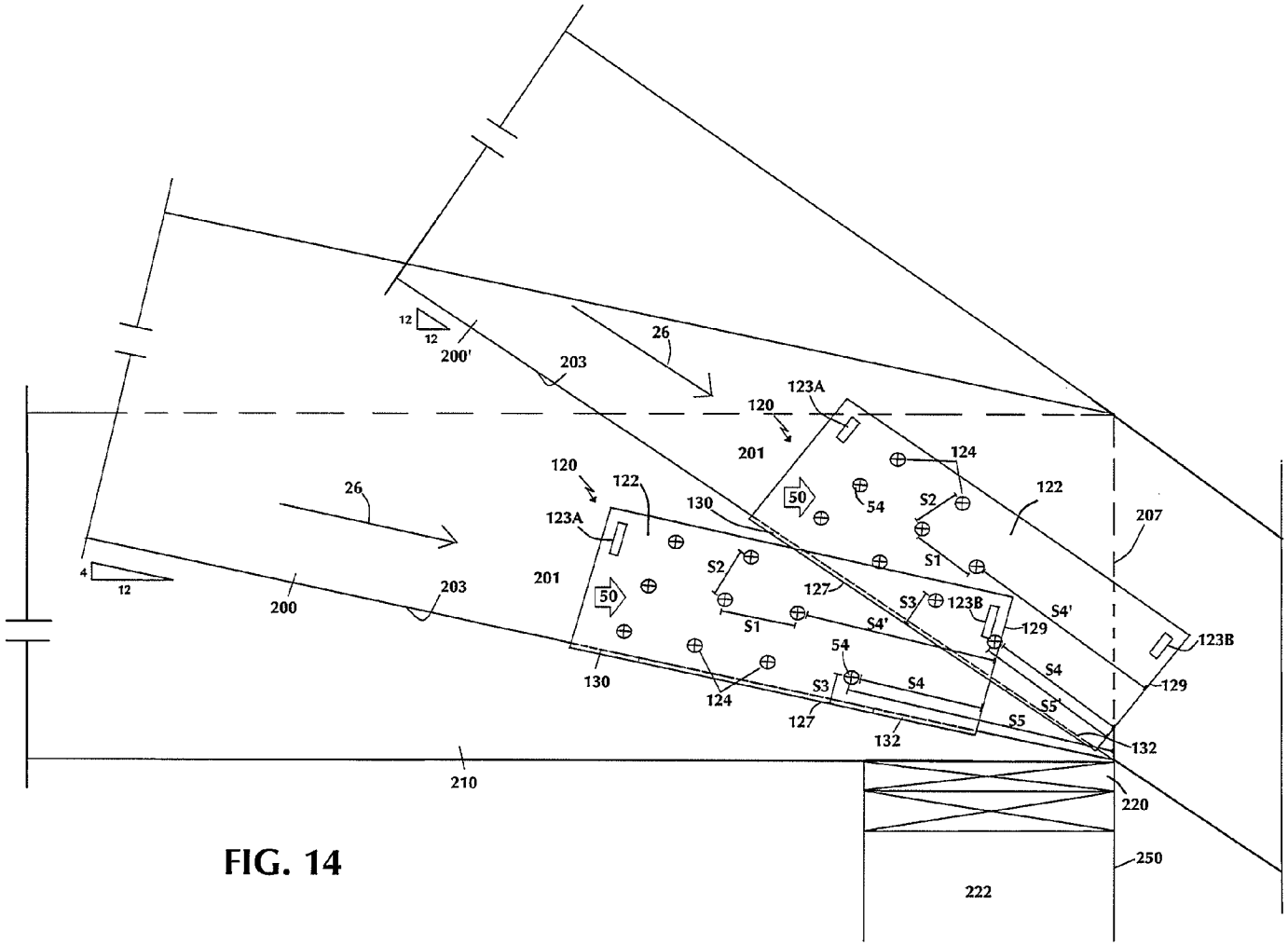
FIG. 14 depicts a side view of a heel joint wherein rafters are positioned at two different pitch angles, and the framing member of the self-adjusting heel joint connector of the present invention is used as a guide to set where fasteners are to be properly fastened through the rafter into the adjacent joist/tie member to transfer rafter thrust force.

In such an event, the framing member of the heel joint connector of the present invention may be used as a guide for the craftsman in the field to provide markings for proper fastener placement to transfer the rafter thrust force to the joist/tie member. As shown in FIG. 14, the vertical leg 122 of framing member 120 may be fabricated to include different sets 50 of pre-punched through-holes 124. A craftsman simply places the vertical leg 122 of the framing member 120 flush against the rafter face 201 at the heel joint (where the rafter overlaps with the adjacent joist/tie member), scoring or marking the rafter through each designated through-hole 124, before removing the vertical leg 122 and driving fasteners through the rafter face 201 and into the adjacent joist/tie member 210 at the proper markings 54. The framing member may be detachable from the support member and used as a guide to provide proper marking for fasteners (as shown in FIG. 14), or may be used in conjunction with an attached support member, such as support member 110, in accordance with the object of the present invention.

The size, spacing and position of each through-hole 124 in each set 50 are positioned so as to ensure that when the rafter pitch varies, the compression and tension forces on the fasteners remain perpendicular to the wood grain in both the rafter 200 and the adjacent joist/tie member 210 and the pre-designed load capacity is achieved. As shown in FIG. 14, the plurality of pre-punched through-holes 124 in set 50 are oriented in a plurality of rows along a longitudinal axis of the vertical leg 122 to form a substantially pyramidal shape when viewed in a direction normal to the longitudinal axis of the vertical leg 122. As depicted in FIG. 14, each through-hole 124 is spaced a predetermined distance S1 from each adjacent through-hole 124 in the same row, and each row is spaced a predetermined distance S2 from its adjacent rows, wherein S1 is not equal to S2. The bottom row of through-holes 124 is spaced a predetermined distance S3 from the bottom edge 127 of vertical leg 122, in accordance with design requirements. The through-hole 124 in each row that is closest to the heel joint (when the vertical leg 122 is positioned against the rafter face 201 as a guide) is spaced a distance from the side edge 129 of vertical leg 122, such that when the guide is positioned by the craftsman, the through-hole 124 that is closest to the heel joint in each row (and thereafter the fastener driven through the corresponding marking 54) is positioned a predetermined distance from the edge 207 of joist 210, in accordance with design requirements. As shown in FIG. 14, the required distance between the through-hole 124 that is closest to the heel joint in each row and the edge 207 of joist 210 varies and is dependent upon the rafter pitch, such as a distance S5 for a rafter set at a pitch of 4/12 and a distance S5' for a rafter set at a pitch of 12/12. As further shown in FIG. 14, the distance from the side edge 129 of vertical leg 122 to the closest through-hole 124 in each row increases for each row beginning from the bottom row, such as between a distance S4 (for the bottom row) and a distance S4' (for the row adjacent to the bottom row, to enable proper fastener placement. The spacing layout of the fasteners is primarily determined by the diameter of the fastener used.

As the vertical leg 122 guide is positioned by the craftsman against the face 201 of the rafter at the precise preset rafter pitch (such as rafter 200 at 4/12 or rafter 200' at 12/12, as shown in FIG. 14), the position of the through-holes 124 (and thereafter, the location of the fasteners) will correspondingly re-position to be perpendicular to the rafter thrust force 26 (i.e. parallel to the grain of the wood) and the tension force in the joist/tie member 210, to allow for transfer of the thrust force 26 to the adjacent joist/tie member 210 when fasteners are driven therethrough. Those skilled in the art should appreciate that the size and spacing of the through-holes will vary based upon the type and size of fastener used, as required for a range of designed load capacities.

This important interface at the heel joint (fastener size, spacing and placement) is often not given the attention that is warranted in the field by the craftsman. This is partly due to the required code interpretation for each case and the actual time required for proper layout of fasteners at each rafter. Having proper fastener size, spacing and layout designated by pre-punched through-holes in the vertical leg of the framing member is a feature unique to the self-adjusting heel joint connector of the present invention, which will prevent possible misinterpretation and layout errors by the craftsman, while allowing for transfer of the thrust force to the adjacent joist/tie member.

Referring again to FIG. 4, in at least one embodiment of the present invention, framing member vertical leg 122 may include one or more placement teeth 123*a*, 123*b* neither either edge of the vertical leg 122 for piercing the rafter to provide temporary stability while the rafter is fastened to the adjacent joist/tie member through the heel joint connector of the present invention. Framing member vertical leg 122 may also include a positioning tab 130 offset a predetermined distance from the framing member horizontal leg 132 and on the same plane as framing member horizontal leg 132. Positioning tab 130 provides additional positioning for a rafter fit between the vertical and horizontal legs of the framing member 120.

Figure 5:
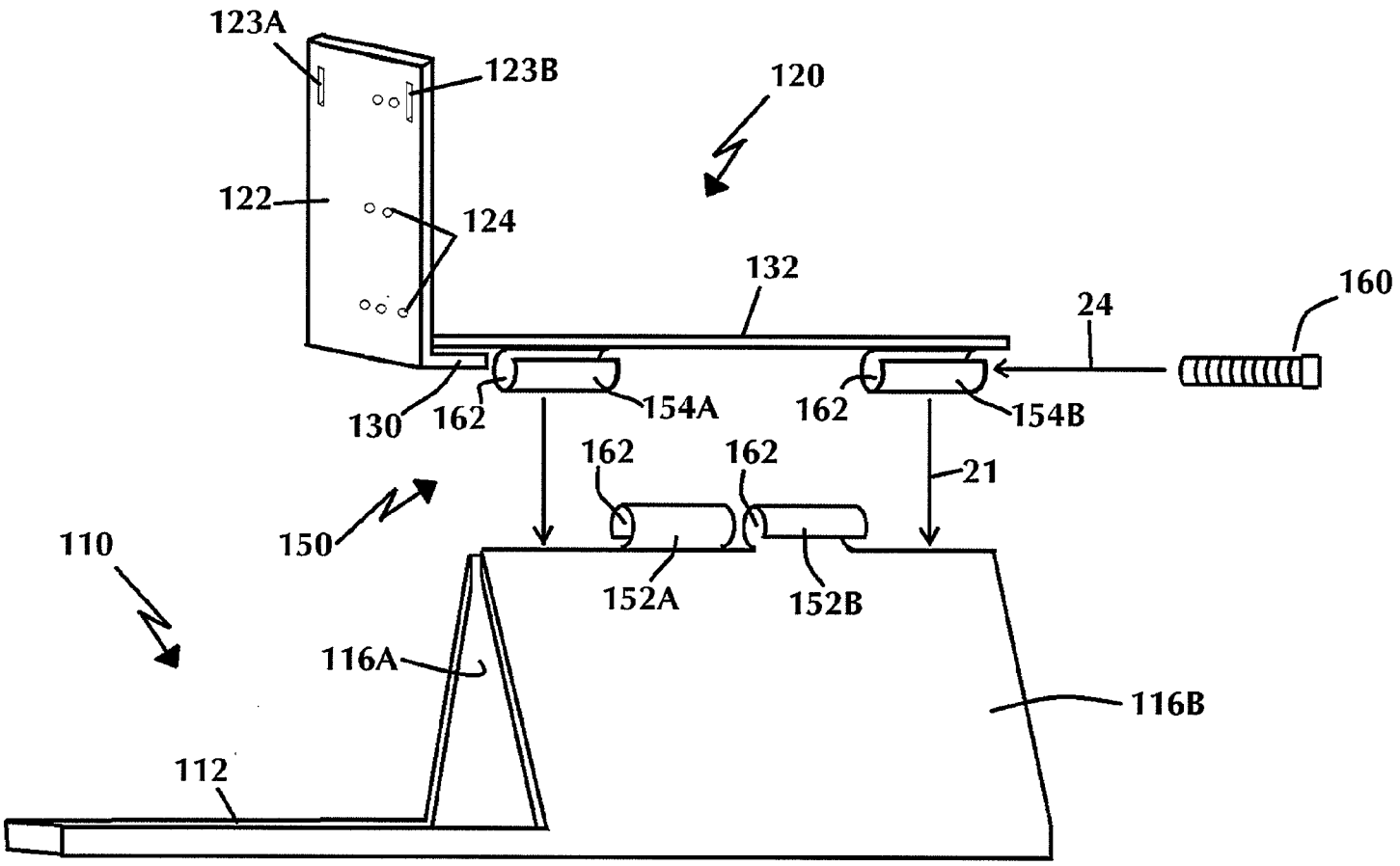
FIG. 5 depicts an exploded perspective view of the embodiment of the self-adjusting heel joint connector of the present invention shown in FIG. 4.

FIG. 5 shows an exploded perspective view of the embodiment of the self-adjusting heel joint connector shown in FIG. 4. As depicted in FIG. 5, the swivel joint may be capable of receiving a pin connector 160 inserted therethrough. The ends of pin connector 160 may be flared during assembly of the connector to stay its position during rotation, and preferably, the ends of pin connector 160 are flush with the ends of swivel joint 150 so as to prevent interference with adjacent structural member(s) when the heel joint connector is being placed at a heel joint.

As further shown in FIG. 5, swivel joint 150 may be comprised of a plurality of mounting loops 152*a*, 152*b*, 154*a*, 154*b*, which are mutually aligned to allow for insertion of a pin connector 160 therethrough. As depicted in FIG. 5, framing member 120 and support member 110 are each fabricated from a single sheet of light gage metal. Mounting loops 152*a*, 152*b* are integral with support member 110, and mounting loops 154*a*, 154*b* are integral with framing member 120, and all mounting loops are formed to accommodate the insertion of pin 160 therethrough. When framing member 120 is mated with support member 110 in the direction of arrow 21, mounting loops 152*a*, 152*b*, 154*a*, 154*b* are aligned to form a channel 162 for insertion of pin connector 160 in the direction of arrow 24.

Figure 6:
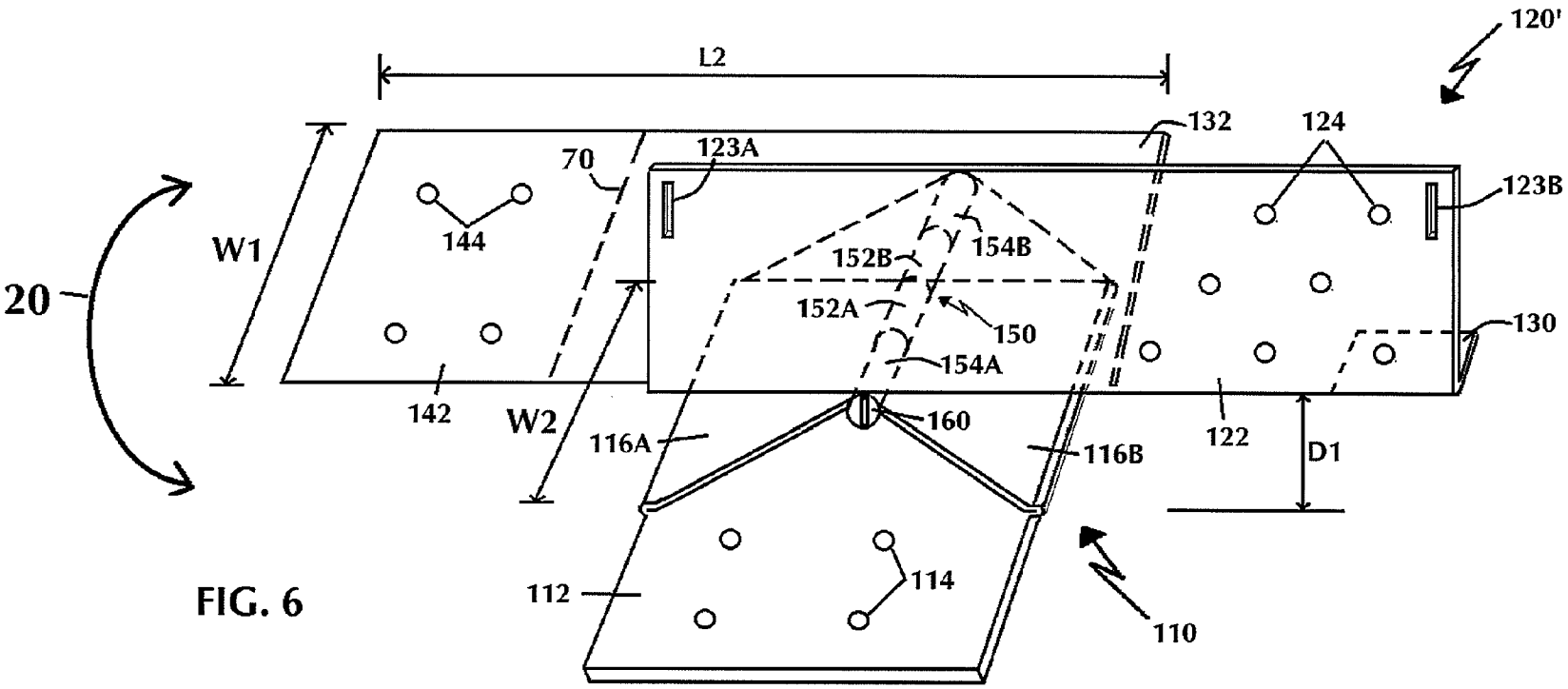
FIG. 6 depicts a perspective view of another embodiment of the self-adjusting heel joint connector of the present invention, wherein the framing member and support member are each formed from bent sheet metal.

FIG. 6 shows an alternative embodiment of the self-adjusting heel joint connector of the present invention. In this embodiment, framing member 120' is rotatably secured to support member 110 about swivel joint 150. Framing member 120' has a horizontal leg 132 having a width W1 and length L2 and further includes a tab 142 extending in the direction of an outside face of an exterior stud (not shown). Tab 142 is capable of being folded along line 70 in the direction of the exterior stud and includes a plurality of through-holes 144 for fasteners to be inserted or driven therethrough to secure the tab to the side of the supporting wall plate and exterior stud, as shown in FIG. 3. Line 70 is shown for exemplary purposes only, as the fold line will be positioned accordingly to meet field design requirements. The number of through-holes is shown as four for illustrative purposes only, as, again, the size, quantity and placement of fasteners (and corresponding through-holes) is design-dependent to ensure for maximum securing strength while minimizing lateral movement or racking. By also securing the connector of the present invention to the side of the supporting wall plate and exterior stud, additional anchorage is created against uplift forces, such as high winds or hurricane forces.

FIG. 7 depicts an alternative embodiment of the support member of the self-adjusting heel joint connector of the present invention, wherein support member 110' includes an extended portion 116' with a triangular cross-section disposed in the direction of swivel joint 150'. As shown in FIG. 7, support member 110' includes extended portion 116', with integral mounting loops 152*a*', 152*b*'. Support member 110' with extended portion 116' is formed from forged metal or cast steel, thereby forming a solid triangular cross-section. Mounting loops 152*a*', 152*b*' are disposed from the top of extended portion 116' and aligned to form swivel joint 150', including a channel 162' for insertion of a pin connector (not shown). Support member 110' has a flat base surface 112', and includes a plurality of through-holes 114' for fasteners to secure the support member 110' to the top of a supporting wall plate. The number of through-holes is shown as four, for illustrative purposes only, as the size, quantity and placement of fasteners (and corresponding through-holes) is design-dependent to ensure for maximum securing strength while minimizing lateral movement or racking. Support member 110' may be mated with a framing member, such as framing member 120 or framing member 120', to form the self-adjusting heel joint connector of the present invention, wherein framing member 120 or 120' is freely rotatable with respect to support member 110' about swivel joint 150', within a predetermined rafter pitch range.

FIG. 8 depicts another embodiment of the support member of the self-adjusting heel joint connector of the present invention, wherein support member 110" includes two extended portions 116*a*", 116*b*" integral with the flat base surface 112", positioned plumb and disposed from a midpoint of the flat base surface 112" in the direction of swivel joint 150". As shown in FIG. 8, support member 110" is fabricated from a single sheet of light gage steel, which is then machine bent along lines 70 to form extended portions 116*a*", 116*b*", with integral mounting loops 152*a*", 152*b*". Support member 110" may also be fabricated from materials other than light gage steel, such as cast steel, forged metal or the like. Mounting loops 152*a*", 152*b*" are disposed from extended portions 116*a*", 116*b*", respectively, and aligned to form swivel joint 150", including a channel 162" for insertion of a pin connector (not shown). Support member 110" has a flat base surface 112", and includes a plurality of through-holes 114" for fasteners to secure the support member 110" to the top of a supporting wall plate. The number of through-holes is shown as four, for illustrative purposes only, as, again, the size, quantity and placement of fasteners (and corresponding through-holes) is design-dependent to ensure for maximum securing strength while minimizing lateral movement or racking. Support member 110" may be mated with a framing member, such as framing member 120 or framing member 120' to form the self-adjusting heel joint connector of the present invention, wherein framing member 120 or 120' is freely rotatable with respect to support member 110" about swivel joint 150", within a predetermined rafter pitch range.

FIG. 9 depicts yet another embodiment of the support member of the self-adjusting heel joint connector of the present invention, wherein support member 116''' includes one perpendicular extended portion 116''' integral with the flat base surface 112''' and disposed from a midpoint of the flat base surface 112''' in the direction of swivel joint 150'''. As shown in FIG. 9, support member 110'' is formed from cast steel or forged metal, or is a welded assembly, and includes extended portion 116''' with integral mounting loops 152*a*'''152*b*'''. Mounting loops 152*a*''', 152*b*''' are disposed from extended portion 116''' and aligned to form swivel joint 150''', including a channel 162''' for insertion of a pin connector (not shown). Support member 110''' has a flat base surface 112''', and includes a plurality of through-holes 114''' for fasteners to secure the support member 110''' to the top of a supporting wall plate. The number of through-holes is shown as four, for illustrative purposes only, as, again, the size, quantity and placement of fasteners (and corresponding through-holes) is design-dependent to ensure for maximum securing strength while minimizing lateral movement or racking.

Support member 110''' may be mated with a framing member, such as framing member 120 or framing member 120', to form the self-adjusting heel joint connector of the present invention, wherein framing member 120 or 120' is freely rotatable with respect to support member 110''' about the swivel joint 150''', within a predetermined rafter pitch range.

Figure 11A:
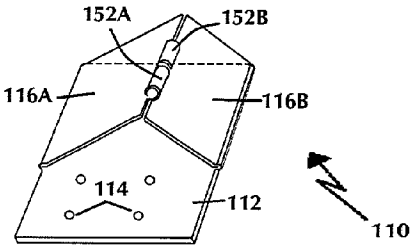
FIG. 11A depicts a perspective view of the support member of one embodiment of the self-adjusting heel joint connector of the present invention, as shown in FIGS. 4-6, after folding along the dotted lines in FIG. 10A.
Figure 11B:
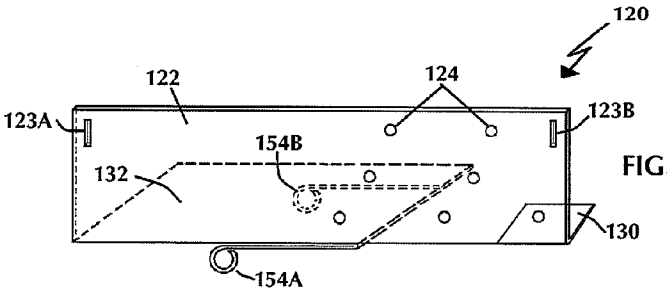
FIG. 11B depicts a perspective view of the framing member of one embodiment of the self-adjusting heel joint connector of the present invention, as shown in FIGS. 4-5, after folding along the dotted lines in FIG. 10B.
Figure 11C:
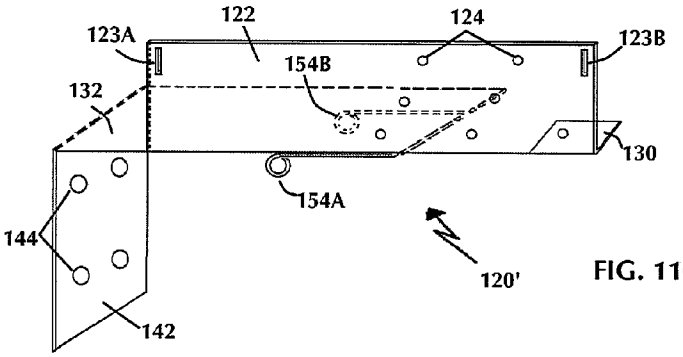
FIG. 11C depicts a perspective view of another embodiment of the framing member of the self-adjusting heel joint connector of the present invention, as shown in FIG. 6, after folding along the dotted lines in FIG. 10C.
Figure 10A:
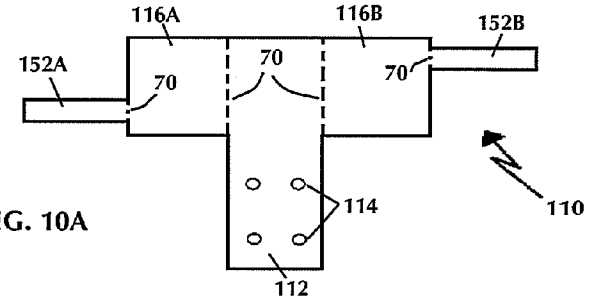
FIG. 10A depicts the support member of one embodiment of the self-adjusting heel joint connector of the present invention, as shown in FIGS. 4-6, prior to forming the finished support member by folding along the dotted lines.
Figure 10B:
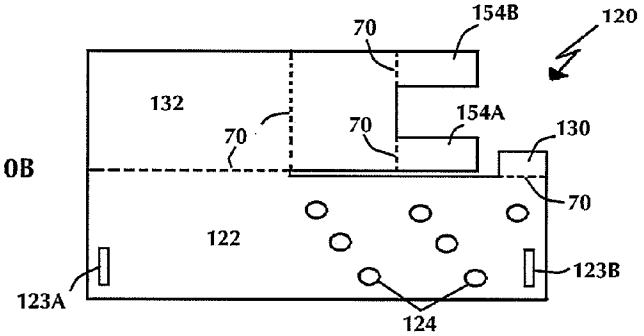
FIG. 10B depicts the framing member of one embodiment of the self-adjusting heel joint connector of the present invention, as shown in FIGS. 4-5, prior to forming the finished support member by folding along the dotted lines.
Figure 10C:
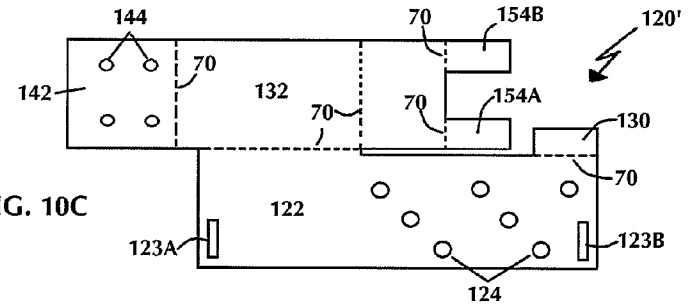
FIG. 10C depicts the framing member of another embodiment of the self-adjusting heel joint connector of the present invention, as shown in FIG. 6, prior to forming the finished support member by folding along the dotted lines.

FIGS. 10A-10C and 11A-11C depict embodiments of the support member and framing member, respectively, of the present invention, wherein the support member and framing member are each fabricated from a single sheet of light gage steel, as shown in FIGS. 4-6. As shown in FIG. 10A, support member 110 is fabricated from a single sheet of light gage steel, which is then machine bent along lines 70 to form a flat base surface 112 having extended portions 116*a*, 116*b* with integral mounting loops 152*a*, 152*b*, as shown in FIG. 11A. Similarly, framing member 120 may be fabricated from a single sheet of light gage steel, which is then machine bent along lines 70 to form vertical leg 122 and horizontal leg 132, with integral mounting loops 154*a*, 154*b*, as shown in FIGS. 10B and 11B. The combination of support member 110 and framing member 120 to form the heel joint connector of the present invention is depicted in FIGS. 4-5. FIGS. 10C and 11C depict an alternative embodiment of the framing member of the present invention, framing member 120', which is fabricated in the same manner as described above, and further includes tab 142. Framing member 120' is shown in combination with support member 110 to form the self-adjusting heel joint connector of the present invention, in FIG. 6. Line 70 on tab 142 is positioned as shown for exemplary purposes only, and may be positioned accordingly per field requirements.

Figure 12B:
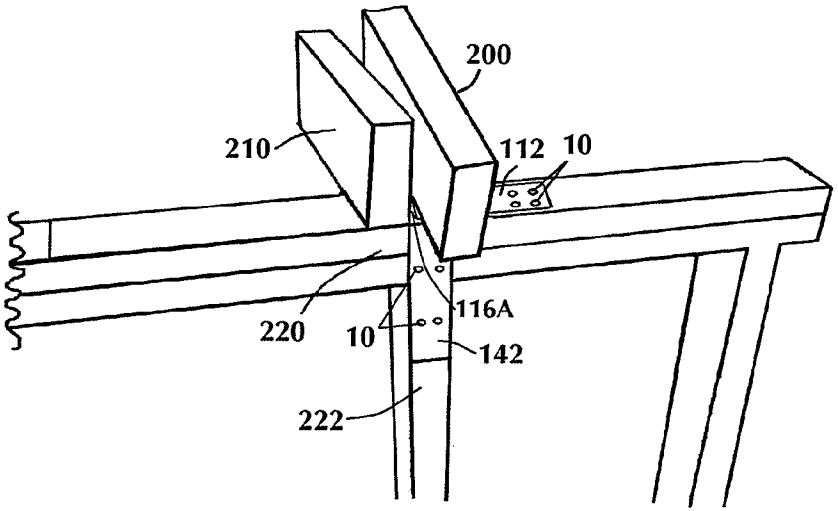
FIG. 12B depicts a perspective view of the heel joint including the self-adjusting heel joint connector of the present invention, as shown in FIG. 12A.
Figure 12A:
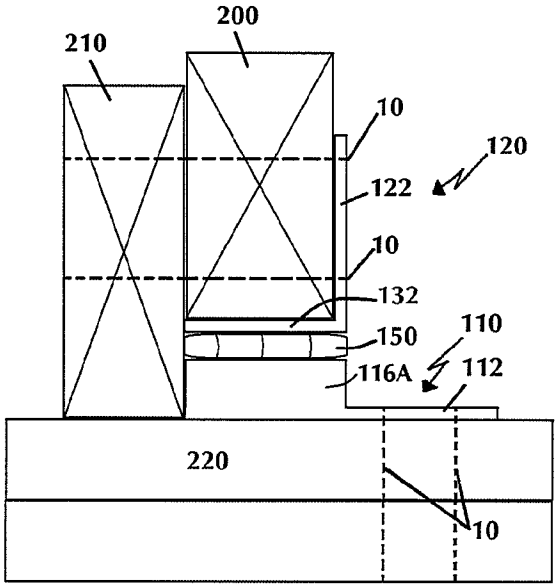
FIG. 12A depicts a cross-sectional view of a heel joint including the self-adjusting heel joint connector of the present invention.

FIG. 12A depicts a cross-sectional view of a typical heel joint including the self-adjusting heel joint connector of the present invention secured therein. As shown in FIG. 12A, support member 110 is secured to top wall plate 220 (shown here as a double plate) by way of fasteners 10 driven through a plurality of through-holes (not shown) in flat base surface 112. Framing member 120 is rotatably secured to support member 110 about swivel joint 150, which is offset from flat base surface 112 by extended portions 116*a* and 116*b* (not shown). Framing member 120 is secured to angled rafter 200 at a preset rafter pitch by fasteners 10 inserted through properly-positioned through-holes (not shown) in framing member vertical leg 122, which is flush against the surface of rafter 200 opposite joist/tie 210. The fasteners 10 protrude through rafter 200 and into adjacent joist/tie 210, which extends laterally above and perpendicular to top wall plate 220. Rafter 200 sits substantially flush against framing member vertical leg 122 and the top surface of framing member horizontal leg 132.

FIG. 12B shows a perspective view of the heel joint including the self-adjusting heel joint connector of the present invention secured therein, as shown in FIG. 12A. FIG. 12B further shows framing member horizontal leg tab 142 which has been folded downward in the direction of exterior stud 222 and secured to the side of top wall plate 220 and the outside face of exterior stud 222 using a plurality of through-fasteners 10. As shown in FIG. 12A and further shown in FIG. 12B, the connector of the present invention enables angled rafter 200 to remain flush against the surface of adjacent joist/tie 210 after placement, while transferring full vertical rafter load through the connector directly to the top of the supporting wall plate and providing increased lateral structural stability. In that the connector of the present invention has no protrusions or projections extending between the rafter and the adjacent joist/tie member, the connector allows the rafter 200 to be placed flush against the joist/tie member 210 for full surface contact, such that the fasteners are capable of providing full capacity for load transfer. Moreover, the flush contact between the rafter 200 and joist/tie 210 allows for complete transfer of the rafter thrust force to the joist/tie, as required to complete the structural system, as shown in FIG. 2.

Figure 13:
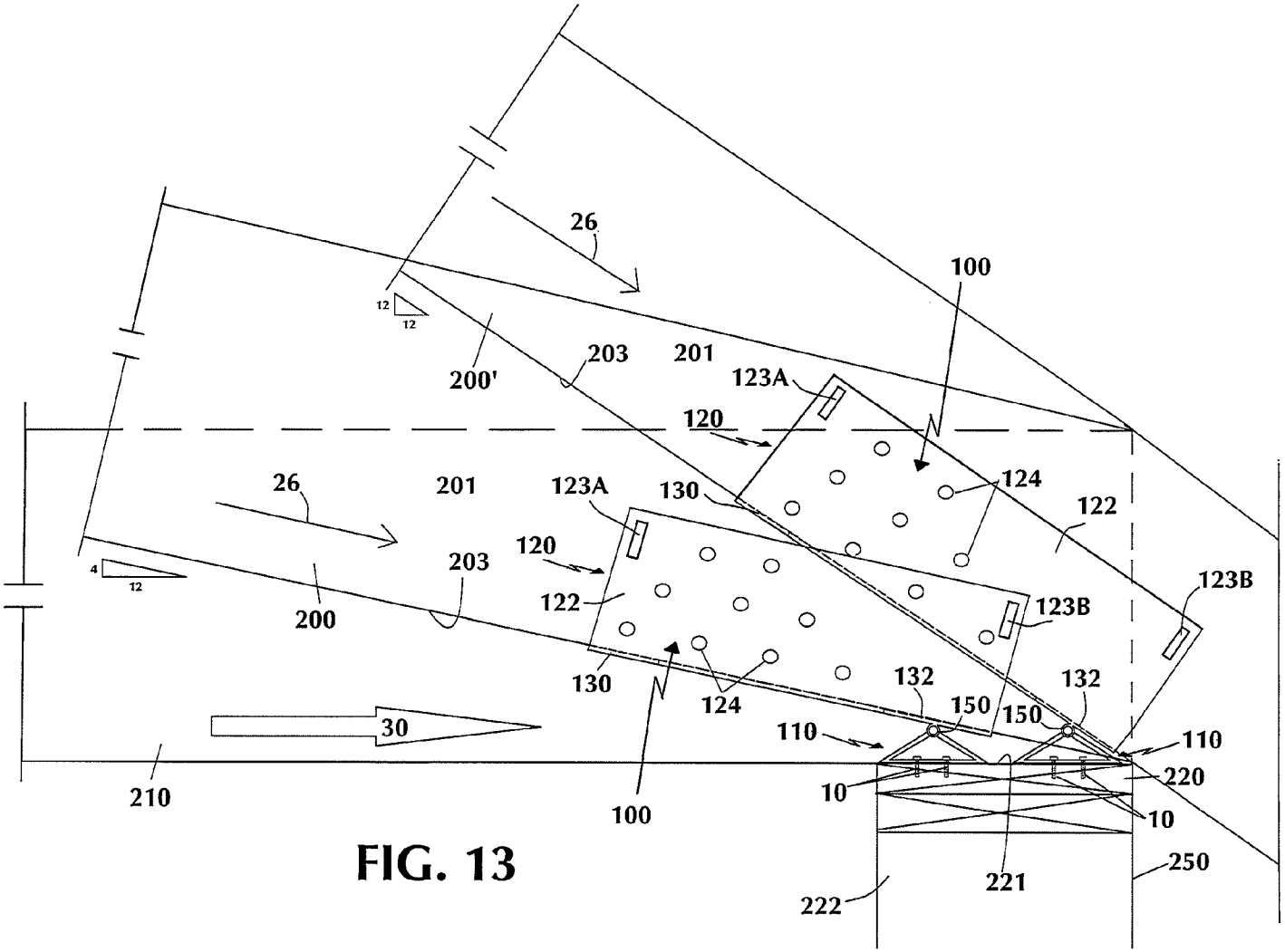
FIG. 13 depicts a side view of a heel joint including the self-adjusting heel joint connector of the present invention, wherein the heel joint connector is slideably inserted between the top of the supporting wall plate and the bottom of the rafter at two different rafter pitch angles. The heel joint connector's ability to self-adjust to a precise preset rafter pitch is depicted.

FIG. 13 depicts a side view of a heel joint including the self-adjusting heel joint connector of the present invention, wherein a heel joint connector is slideably inserted between the top of the supporting wall plate and the bottom of the rafter at two different pitch angles. The heel joint connector's ability to self-adjust to a precise rafter pitch angle during placement is depicted. As shown in FIG. 13, joist/tie 210 is perpendicular to the top of supporting wall plate 220 and rafter 200 is preset at a selected pitch. Heel joint connector 100 has been slideably inserted between the bottom surface 203 of rafter 200 and the top surface 221 of supporting wall plate 220, and moved laterally along the top of the supporting wall plate 220 in the direction of the outside face 250 of the exterior stud 222 (as shown in FIG. 13 by arrow 30) until fully contacting both the bottom surface 203 of rafter 200 and the top surface 221 of supporting wall plate 220.

As the framing member horizontal leg 132 comes into contact with the bottom surface 203 of rafter 200 during placement, the framing member 120 rotates about swivel joint 150 to self-adjust to the precise rafter pitch, enabling the bottom surface 203 of rafter 200 to remain substantially flush with the top surface of framing member horizontal leg 132, while the framing member vertical leg 122 remains flush with the face 201 of rafter 200. The flush contact between the rafter 200 and the vertical and horizontal legs 122, 132 of the connector allows for transfer of the vertical rafter load through the connector directly to the top 221 of the supporting wall plate 220 and transfer of the rafter thrust force 26 to the adjacent joist/tie member 210, completing the structural system As further shown in FIG. 13, heel joint connector 100 is capable of self-adjusting to any precise rafter pitch, including rafter 200', which is preset at a different selected pitch. As the connector framing member 120 rotates about the swivel joint 150 to self-adjust to the precise preset rafter pitch, such as adjusting between a pitch of 4/12 to a pitch of 12/12, as depicted in FIG. 13, the position of the through-holes 124 (and thereafter, the location of the fasteners) will correspondingly reposition to be perpendicular to the rafter thrust force 26 (i.e. parallel to the grain of the wood), to allow for transfer of the thrust force 26 to the adjacent joist/tie member 210 when fasteners are driven therethrough. The heel joint connector of the present invention is shown in FIG. 13 at its two extreme positions on a conventional 2×4 wall plate, for exemplary purposes only, and it should be understood that the connector may self-adjust to accommodate any precise preset rafter pitch between the extreme positions.

The connector of the present invention is set in place by hand to its contact surfaces, and, due to the connector's ability to self-adjust to a precise preset rafter pitch, requires no hammering and field metal bending to acquire full surface contact with the rafter and supporting wall plate. Moreover, there are no marks needed to be stamped on the connector to provide the pitch required: it is self-setting and placed after the rafter has already been set in place by the craftsman to his selected pitch.

The present invention is adaptable to accommodate various sizes of rafters, joist/tie members, wall plates, studs and sheathing, and is not limited to any particular dimensions for these structural components. The self-adjusting heel joint connector is designed to provide a direct load path transfer through each structural member.

Due to its simplicity, size and shape, the connector of the present invention can be readily used with other connectors, such as those used for additional tie-down capacity. The present invention is further adaptable for retrofitting to existing structures and may be used to repair a heel joint of an existing construction.

Thus the present invention achieves one or more of the following advantages. The present invention provides a self-adjusting connector capable of adjoining the structural components at a heel joint in a building, including a rafter, joist/tie, and top wall plate, in a single connector and without the need for a conventional birdsmouth cut. The connector provides for transferring at least minimum code-required surface area between the bottom of a rafter and top of a supporting wall plate, without relying on a skilled craftsman to provide an accurate rafter cut, and eliminates all conventional toe-nailing of the rafter to the supporting wall plate. The connector has no projecting extended sections or protrusions that would interfere with placing adjacent members flush with each other, including joist/tie members or other connectors. The connector is capable of self-adjusting to a precise preset rafter pitch setting for full vertical rafter load transfer through the connector directly to the top of the supporting wall plate and provides for increased lateral structural stability. The connector further serves as a guide for proper placement of fasteners to transfer rafter thrust force to an adjacent joist/tie member.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A heel joint connector for connecting structural members in building roof structures, comprising:

a support member having a flat base surface, the flat base surface including a plurality of through-holes for fasteners to secure the support member to a top surface of a supporting wall plate, the supporting wall plate supported by an exterior stud;

a framing member having a vertical leg and a horizontal leg, the horizontal leg attached to or integral with the vertical leg and positioned at approximately a right angle to the vertical leg, the vertical leg including a plurality of through-holes for fasteners to secure the framing member to a rafter and a joist/tie; and a swivel joint offset from the support member flat base surface, the swivel joint including a pin connector inserted therethrough, wherein the framing member is rotatably secured to the support member about the swivel joint and freely rotatable within a predetermined rafter pitch range, and wherein the pin connector is rotatably secured within the swivel joint such that the pin connector remains in place during rotation of the framing member about the swivel joint.

2. The heel joint connector of claim 1 wherein the framing member is self-adjustable to a precise preset rafter pitch angle when the heel joint connector is slideably inserted between a bottom surface of the rafter and the supporting wall plate top surface and moved laterally along the supporting wall plate top surface in the direction of an outside face of the exterior stud until fully contacting the rafter bottom surface and the supporting wall plate top surface.

3. The heel joint connector of claim 1 wherein the framing member horizontal leg has a tab extending laterally in the direction of an outside face of the exterior stud, the tab forming a plane with the framing member horizontal leg and capable of being folded in the direction of the exterior stud, the tab including a plurality of through-holes for fasteners to secure the tab to an exterior side of the supporting wall plate and the outside face of the exterior stud.

4. The heel joint connector of claim 1 wherein the support member includes at least two extended portions integral with or attached to, and extending from, the flat base surface and disposed in the direction of the swivel joint.

5. The heel joint connector of claim 4 wherein the at least two extended portions and the flat base surface form a triangular cross-section.

6. The heel joint connector of claim 4 wherein the at least two extended portions are positioned plumb and disposed from a midpoint of the flat base surface.

7. The heel joint connector of claim 1 wherein the support member includes one extended portion integral with or attached to, and extending from, the flat base surface and disposed in the direction of the swivel joint.

8. The heel joint connector of claim 1 wherein the framing member vertical leg includes at least one placement tooth, the at least one placement tooth capable of piercing the rafter at a predetermined depth not exceeding the depth of the rafter.

9. The heel joint connector of claim 1 wherein the framing member vertical leg includes a positioning tab integral with or attached to the framing member vertical leg, the positioning tab forming a plane with the framing member horizontal leg and located offset a predetermined distance from the framing member horizontal leg along the plane.

10. The heel joint connector of claim 1 wherein the framing member vertical leg plurality of through-holes are oriented in a plurality of rows along a longitudinal axis of the framing member vertical leg, the plurality of rows forming a substantially pyramidal shape.

11. The heel joint connector of claim 10 wherein each through-hole is spaced a first predetermined distance S1 from each adjacent through-hole in the same row and each row is spaced a second predetermined distance S2 from each adjacent row, wherein S1 is not equal to S2, and wherein the bottom row is spaced a third predetermined distance S3 from a bottom edge of the framing member vertical leg, and the through-hole at the end of each row is spaced a fourth predetermined distance S4 from the adjacent edge of the framing member vertical leg, wherein S4 increases in each row beginning from the bottom row.

12. The heel joint connector of claim 11 wherein the vertical leg plurality of through-holes are spaced so that as the framing member rotates about the swivel joint to adjust to a precise preset rafter pitch, the plurality of through-holes remain positioned perpendicular to the rafter thrust force and the tension force in the joist/tie, to allow for transfer of the rafter thrust force to the joist/tie when fasteners are driven therethrough.

13. The heel joint connector of claim 1 wherein the support member and framing member are each fabricated from a single sheet of gage steel, formed from cast steel or formed from forged metal, and wherein each of the framing member, support member and swivel joint includes a corrosion-preventing protective coating.

14. The heel joint connector of claim 1 wherein the swivel joint is comprised of a plurality of mounting loops, at least one of the plurality of mounting loops attached to or integral with each of the support member and the framing member horizontal leg, the plurality of mounting loops mutually aligned to allow for insertion of the pin connector therethrough.

15. A heel joint connector for connecting structural members in building roof structures, comprising:

a support member having a flat base surface, the flat base surface including a plurality of through-holes for fasteners to secure the support member to a top surface of a supporting wall plate, the supporting wall plate supported by an exterior stud;

a framing member having a vertical leg and a horizontal leg, the horizontal leg attached to or integral with the vertical leg and positioned at approximately a right angle to the vertical leg, the vertical leg including a plurality of through-holes for fasteners to secure the framing member to a rafter and a joist/tie, wherein the joist/tie is adjacent to and flush with the rafter and wherein the fasteners are driven through the rafter into the joist/tie; and a swivel joint offset from the support member flat base surface, wherein the framing member is rotatably secured to the support member about the swivel joint and freely rotatable within a predetermined rafter pitch range.

16. The heel joint connector of claim 15 including a pin connector inserted through the swivel joint, the pin connector rotatably secured within the swivel joint such that the pin connector remains in place during rotation of the framing member about the swivel joint.

17. The heel joint connector of claim 16 wherein the swivel joint is comprised of a plurality of mounting loops, at least one of the plurality of mounting loops attached to or integral with each of the support member and the framing member horizontal leg, the plurality of mounting loops mutually aligned to allow for insertion of the pin connector therethrough.

18. The heel joint connector of claim 15 wherein the framing member vertical leg plurality of through-holes are oriented in a plurality of rows along a longitudinal axis of the framing member vertical leg, the plurality of rows forming a substantially pyramidal shape.

19. The heel joint connector of claim 18 wherein each through-hole is spaced a first predetermined distance S1 from each adjacent through-hole in the same row and each row is spaced a second predetermined distance S2 from each adjacent row, wherein S1 is not equal to S2, and wherein the bottom row is spaced a third predetermined distance S3 from a bottom edge of the framing member vertical leg, and the through-hole at the end of each row is spaced a fourth predetermined distance S4 from the adjacent edge of the framing member vertical leg, wherein S4 increases in each row beginning from the bottom row.

20. The heel joint connector of claim 15 wherein the vertical leg plurality of through-holes are spaced so that as the framing member rotates about the swivel joint to adjust to a precise preset rafter pitch, the plurality of through-holes remain positioned perpendicular to the rafter thrust force and the tension force in the joist/tie, to allow for transfer of the rafter thrust force to the joist/tie when fasteners are driven therethrough.

* * * * *